United States Patent [19]

Basevi

[11] Patent Number: 4,515,371

[45] Date of Patent: May 7, 1985

[54] INSTRUCTIONAL CHESS GAME

[76] Inventor: Licinio Basevi, c/o Mr. I. Cesana, 12218 E. Greenwood Ave., Cerritos, Calif. 90701

[21] Appl. No.: 503,671

[22] Filed: Jun. 13, 1983

[51] Int. Cl.[3] ..... A63F 3/02

[52] U.S. Cl. ..... 273/260; 273/287; 273/289; 446/308; 446/309; 446/336

[58] Field of Search ..... 273/260, 261, 262, 288, 273/289, 85 E, 85 F; 46/142, 145, 148

[56] References Cited

U.S. PATENT DOCUMENTS

| | | | |
|---|---|---|---|
| 3,179,416 | 4/1965 | Büdi | 273/289 |
| 3,466,044 | 9/1969 | Somerville | 273/288 X |
| 3,605,326 | 9/1971 | Baginski et al. | 46/145 X |
| 3,627,324 | 12/1971 | Krepp | 273/260 |
| 4,118,888 | 10/1978 | Ogawa | 46/145 X |
| 4,372,558 | 2/1983 | Shimamoto et al. | 273/238 |

FOREIGN PATENT DOCUMENTS

| | | | |
|---|---|---|---|
| 415762 | 7/1925 | Fed. Rep. of Germany | 46/142 |
| 725504 | 3/1955 | United Kingdom | 273/85 F |

OTHER PUBLICATIONS

Craig Kubey *The Winners Book of Video Games*, p. 65, ©1982.

*Primary Examiner*—Richard C. Pinkham
*Assistant Examiner*—Scott L. Brown

[57] ABSTRACT

An instructional chess game comprises a square playing board of laminated construction having sixty-four individual playing squares each of which is formed centrally with a substantially square recess, all squares "black" and "white" in accordance with traditional contrasting squares configuration, such square recesses being formed to accomodate a variety of play pieces whose projecting basal configuration can be accomodated in the aforesaid play squares square recesses. Such basal configurations of each of the play pieces do permit each and any of the play pieces to rest in the appropriate play squares and face only such directions as are allowed in accordance with the rules of the game of chess, whereby in such attitudes when the playpieces are correctly aligned and resting in the play squares such play pieces are actuated to display and execute an aggressive action appropriate to the character of each particular play piece; the pawns may swing an axe, the kings may swing a sword, the rook-castles, the bishops and queens may propel a projectile whilst the knights may swing a lance, all such representational actions and weapons are to physically attack and strike the opponent playpieces as a prelude to the "taking" of the pieces so attacked. A video chess game is also described during which a substantially conventional chess board is visually represented and similarly represented playing pieces are shown to attack one another by striking each other or by launching projectiles, laser beams or the like at one another, the attacked and visually represented playing pieces collapsing/disintegrating before finally vanishing and being replaced by the attacking playing pieces with suitable sound effects.

13 Claims, 78 Drawing Figures

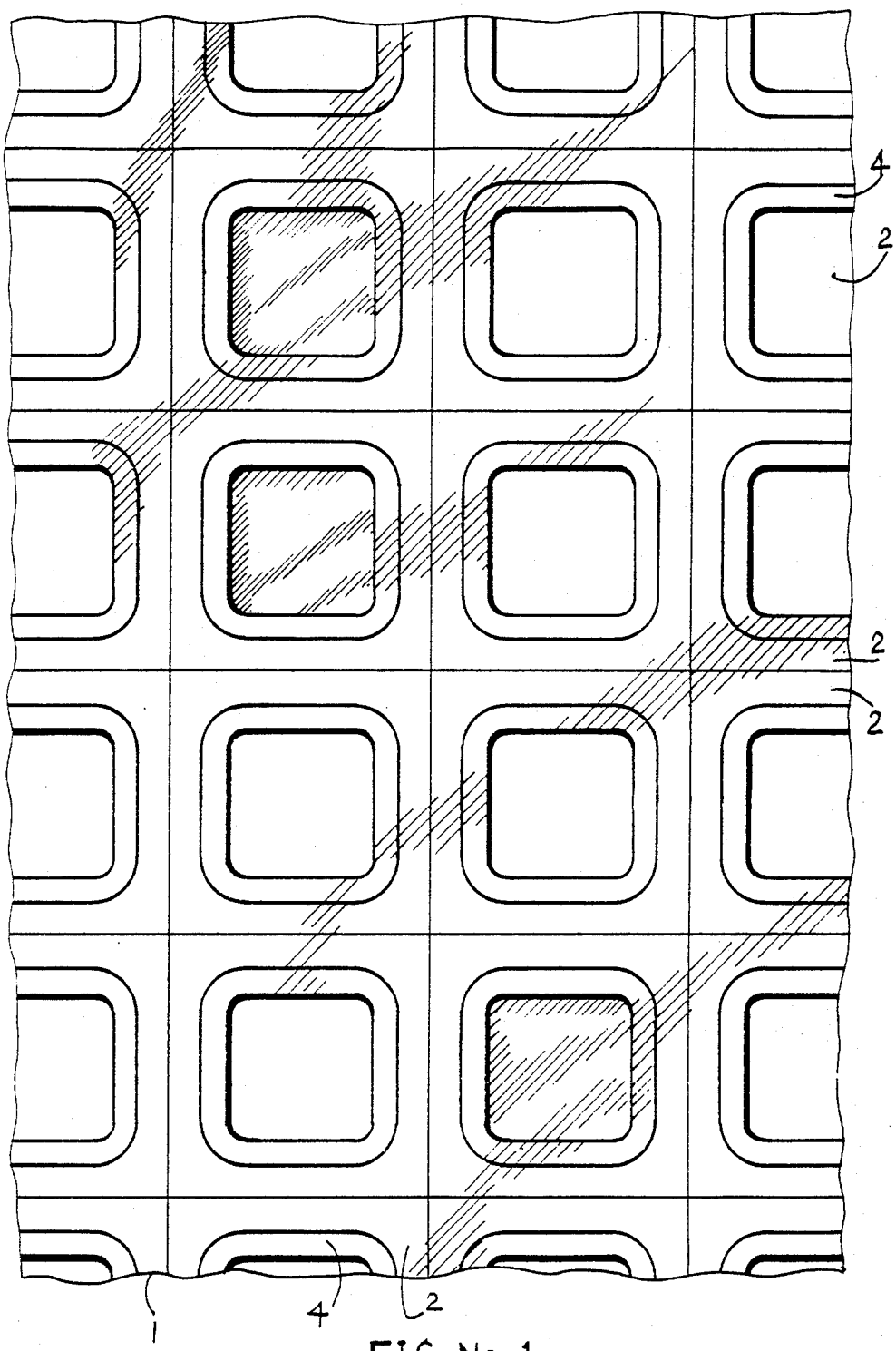
FIG No. 1

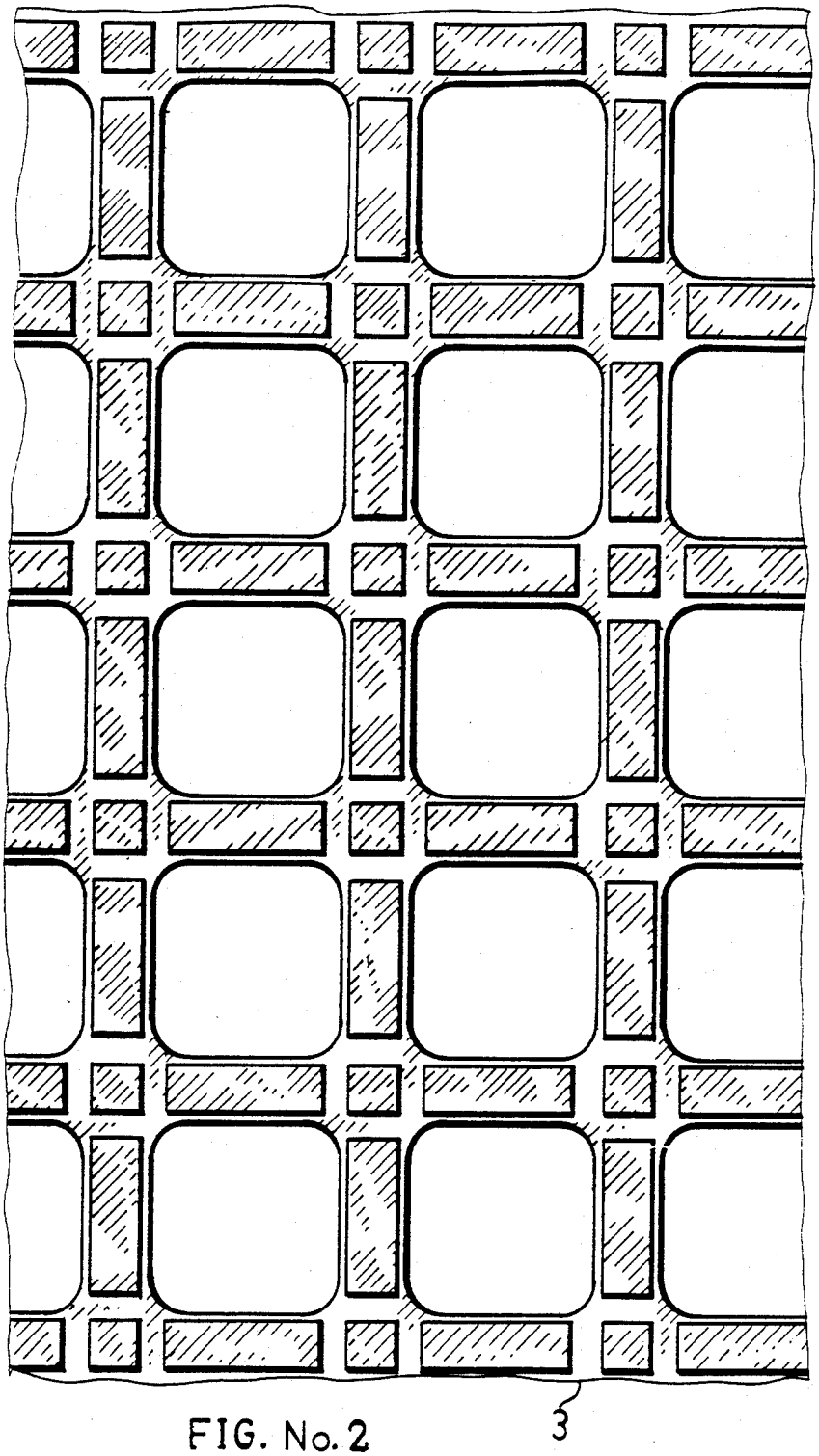
FIG. No. 2

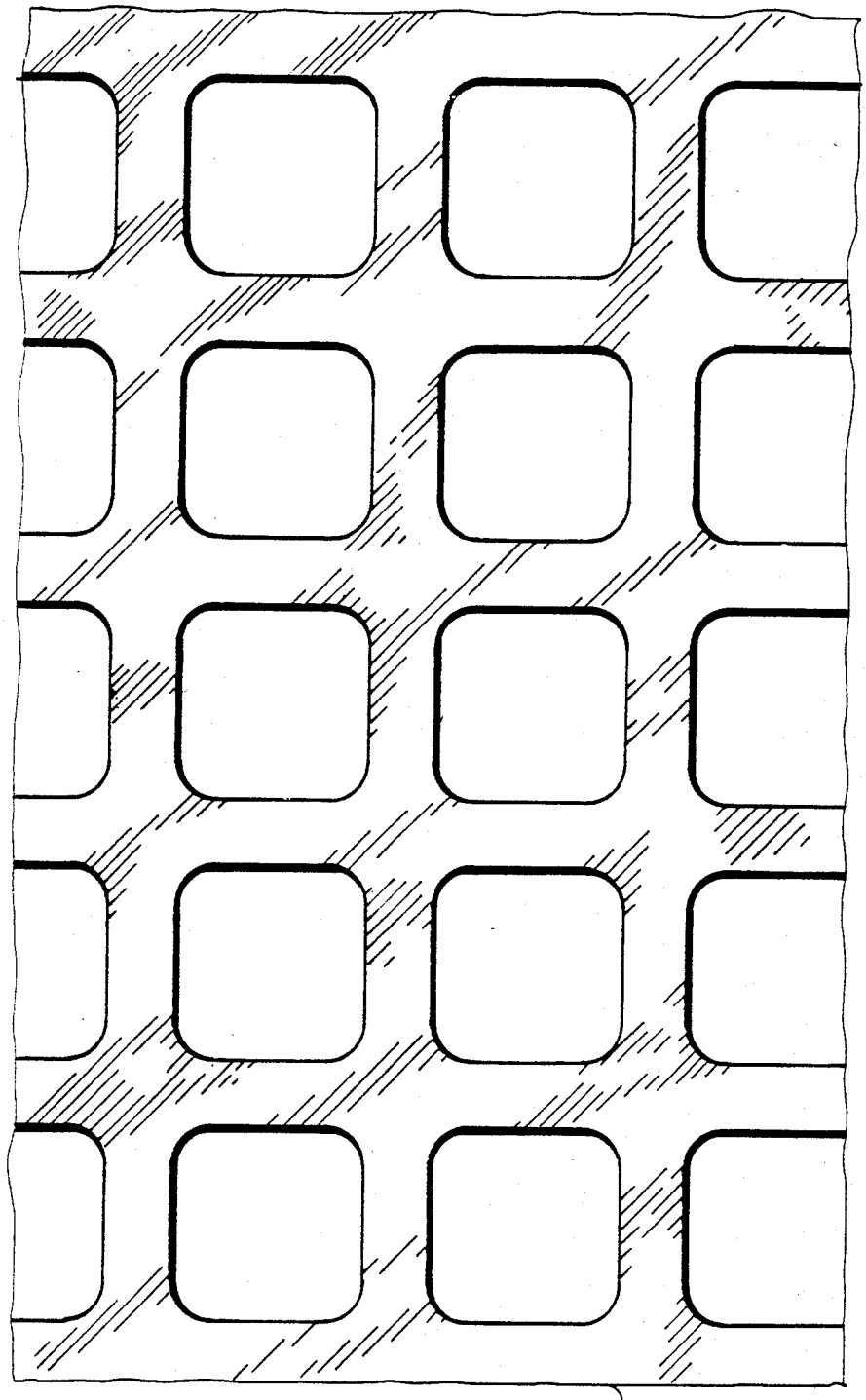
FIG. No. 3
3

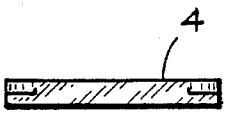
FIG. No. 4
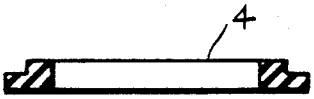
FIG. No. 7
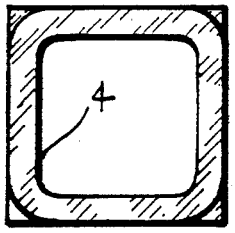
FIG. No. 5
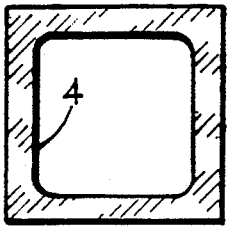
FIG. No. 6
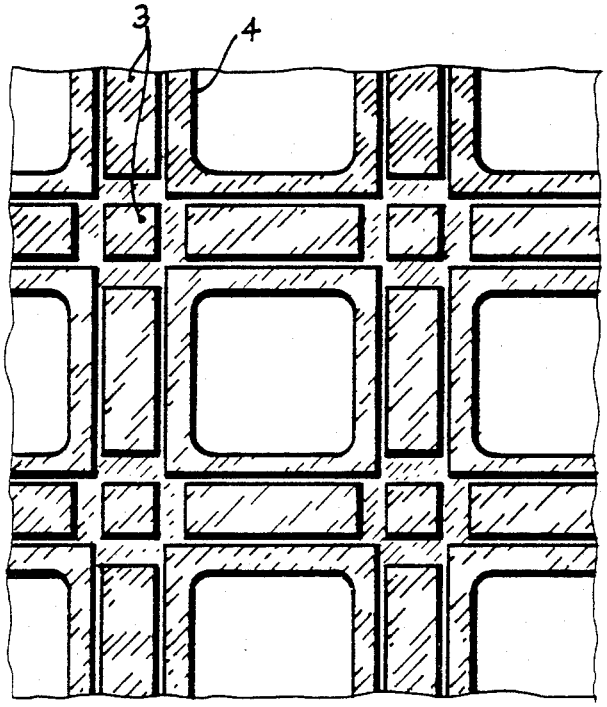
FIG. No. 8

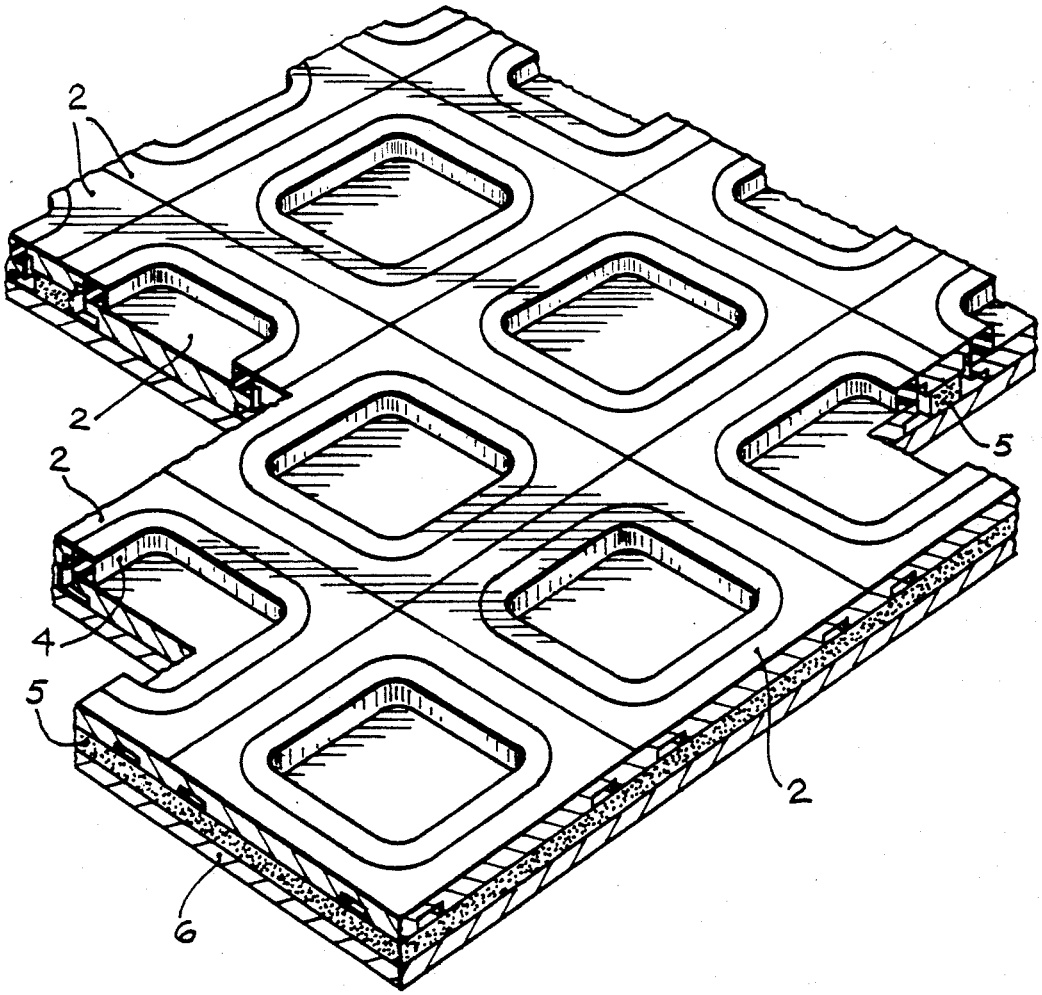
FIG. No. 9

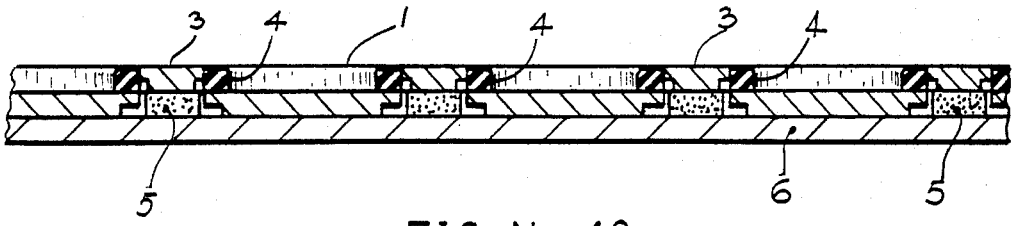
FIG. No. 10
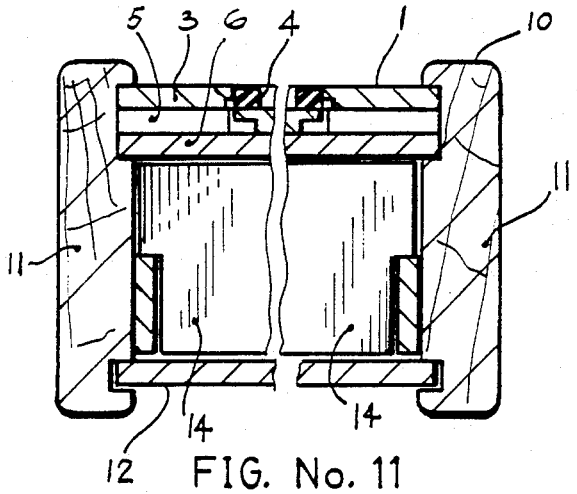
FIG. No. 11
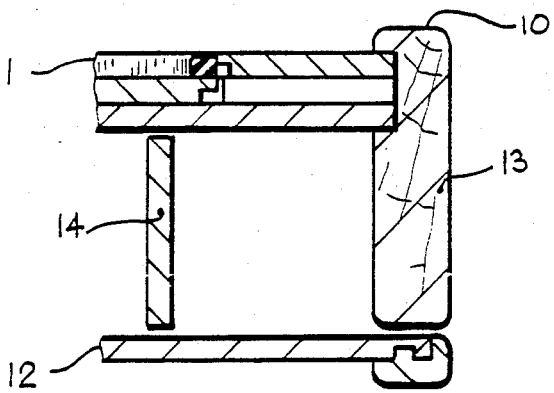
FIG. No. 12

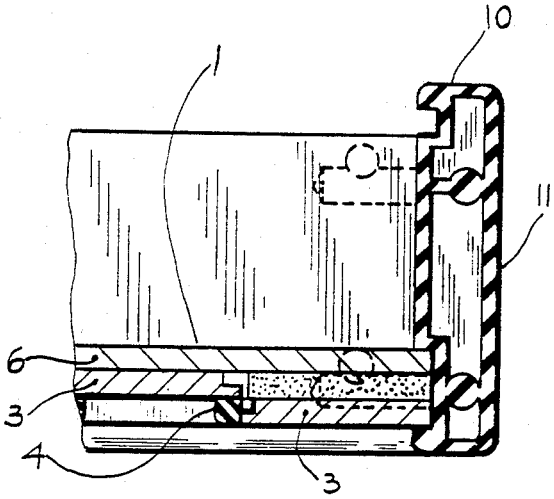
FIG. No. 13
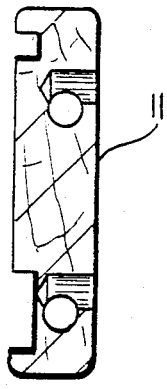
FIG. No. 14
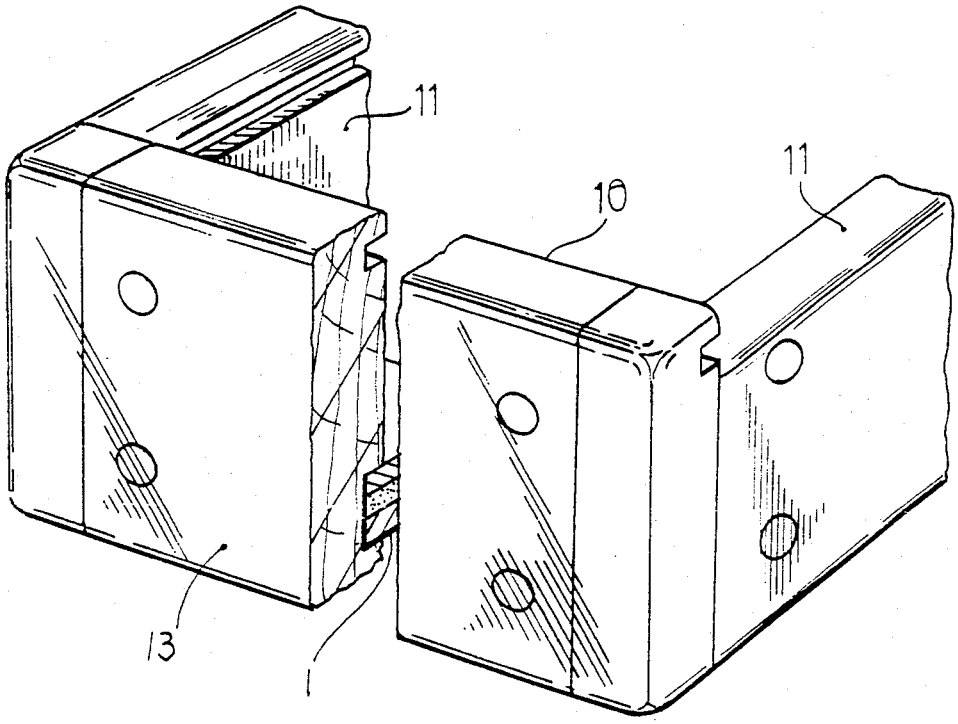
FIG. No. 15

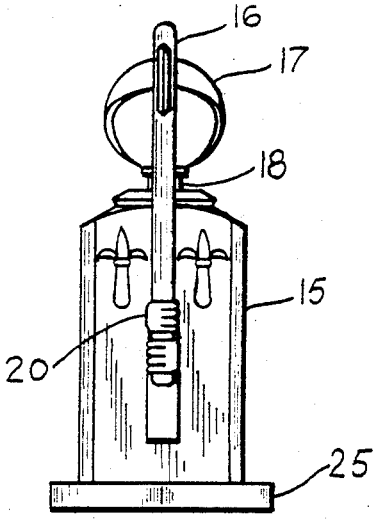
FIG. No.16
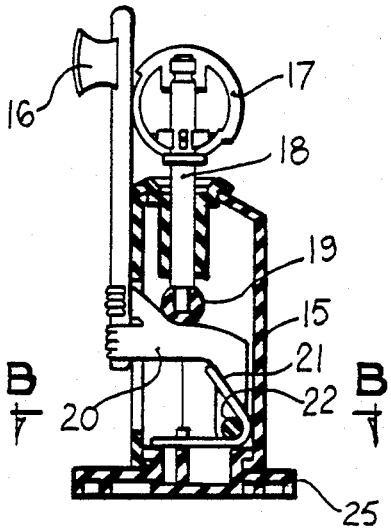
FIG. No.17
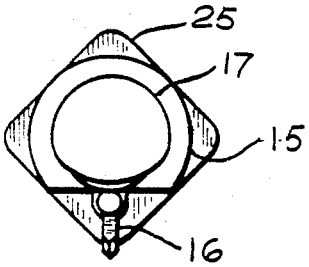
FIG. No.18
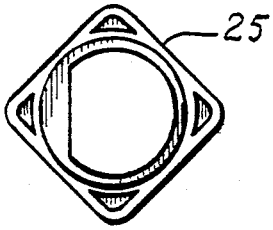
FIG. No.19
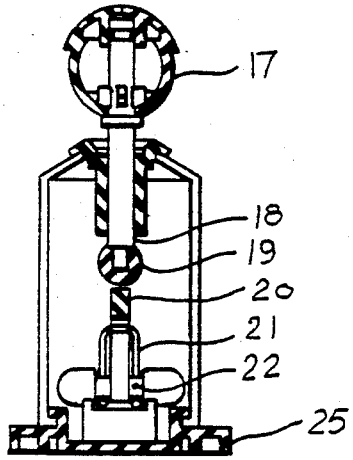
FIG. No. 20
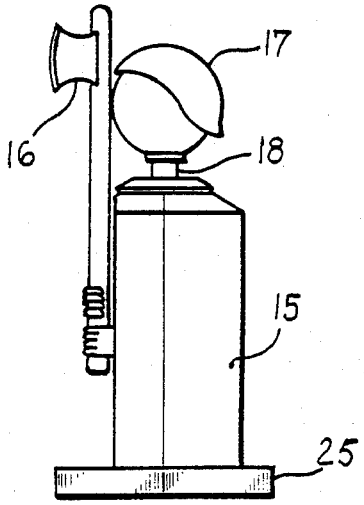
FIG. No. 21

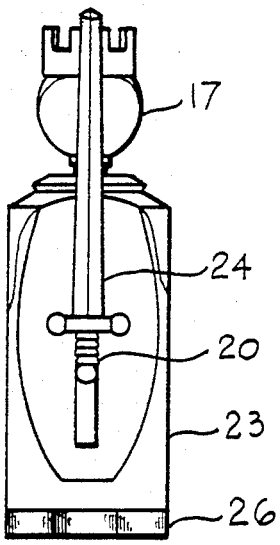
FIG. No. 22
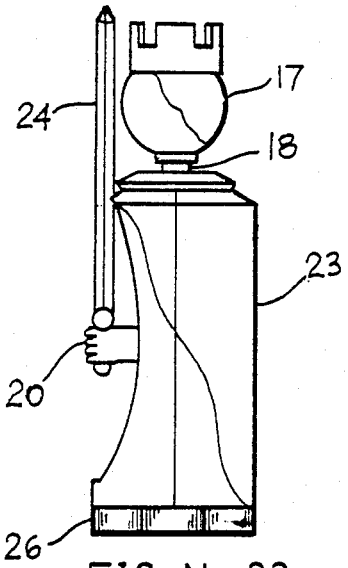
FIG. No. 23
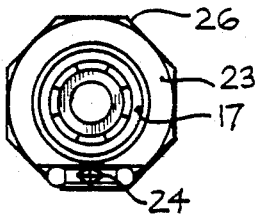
FIG. No. 24
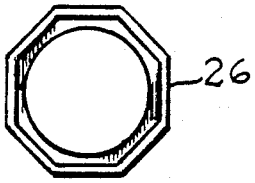
FIG. No. 25
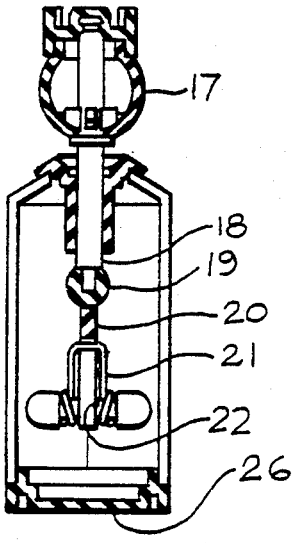
FIG. No. 26
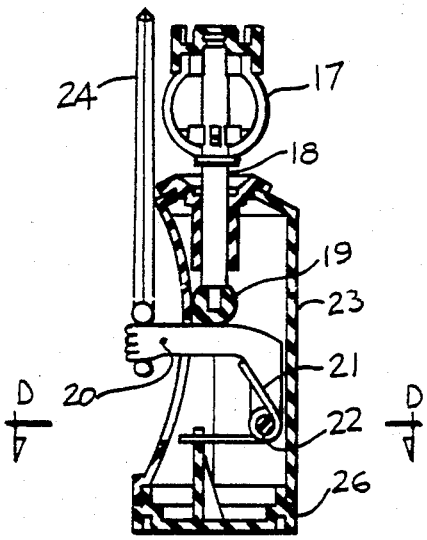
FIG. No. 27

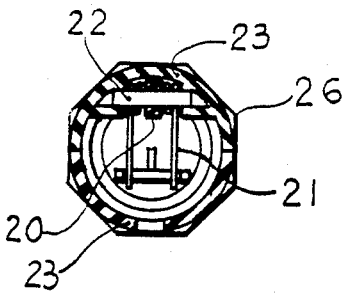
FIG. No. 28
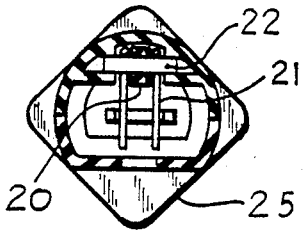
FIG. No. 30
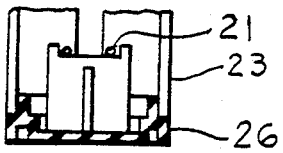
FIG. No. 29
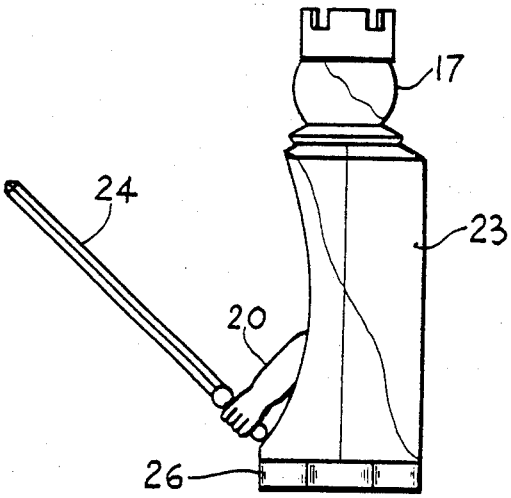
FIG. No.31
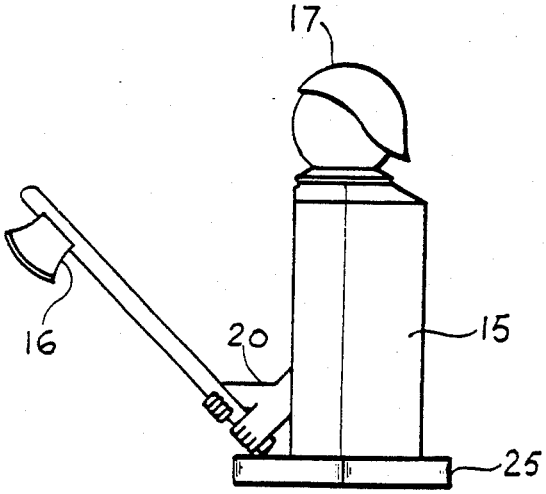
FIG. No. 32

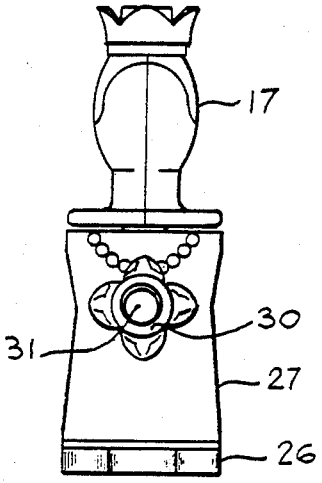
FIG. No.33
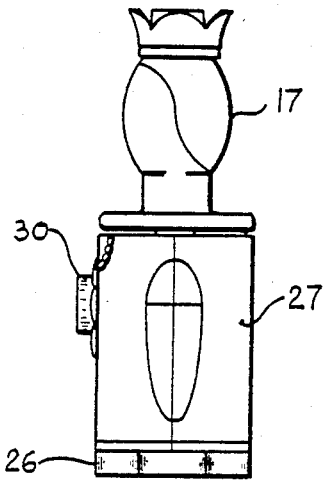
FIG. No.34
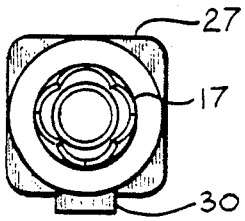
FIG. No.35
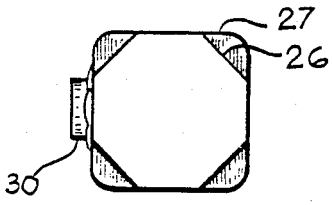
FIG. No.36
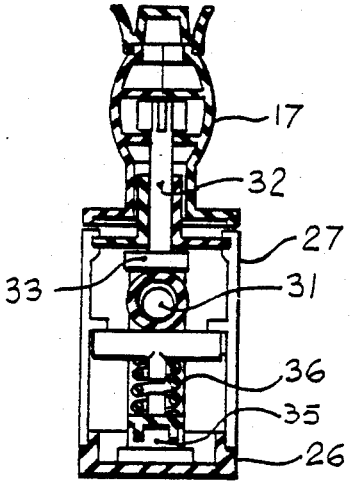
FIG. No.37
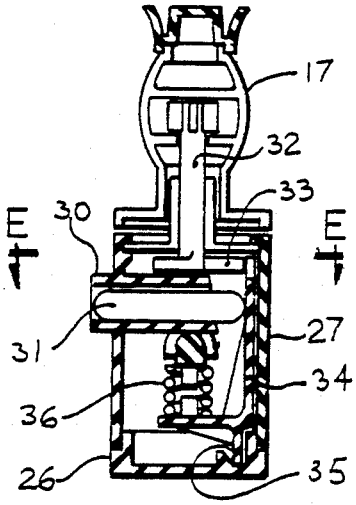
FIG. No.38

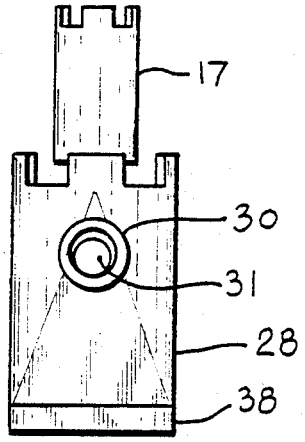
FIG. No. 39
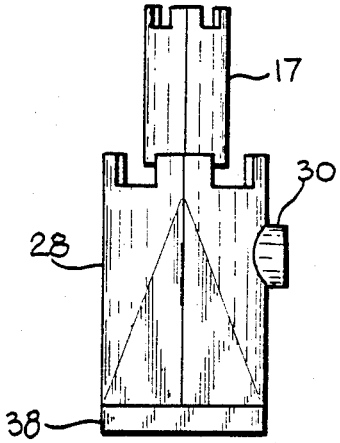
FIG. No. 40
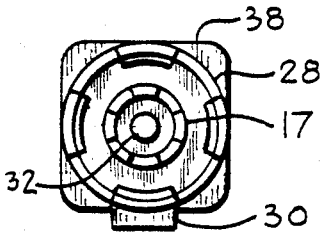
FIG. No. 41
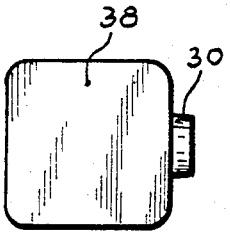
FIG. No. 42
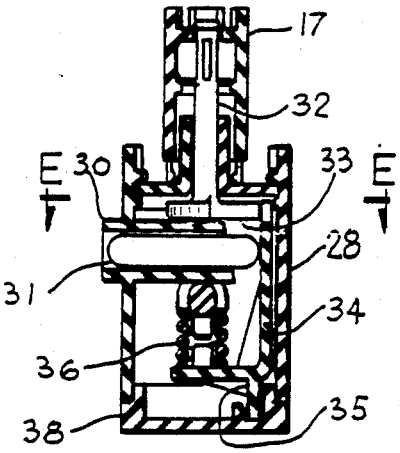
FIG. No. 43
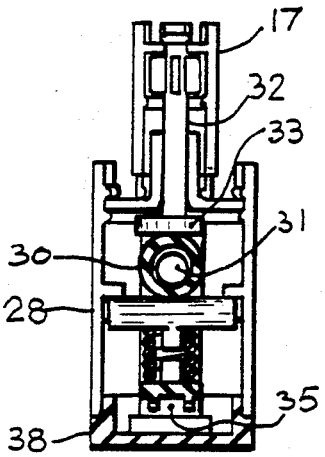
FIG. No. 44

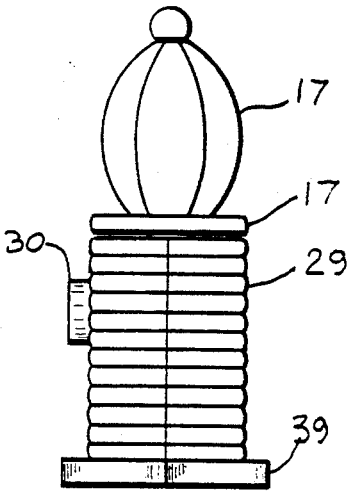
FIG. No.45
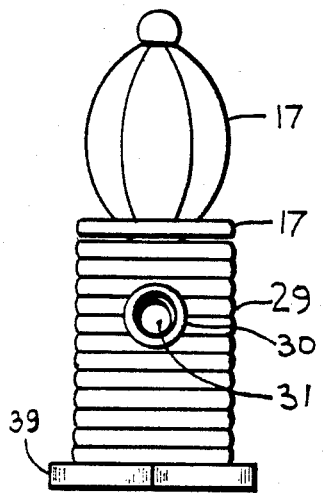
FIG. No.46
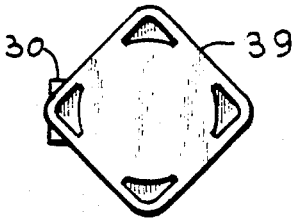
FIG. No.47
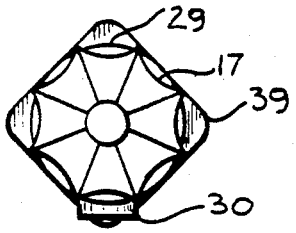
FIG. No.48
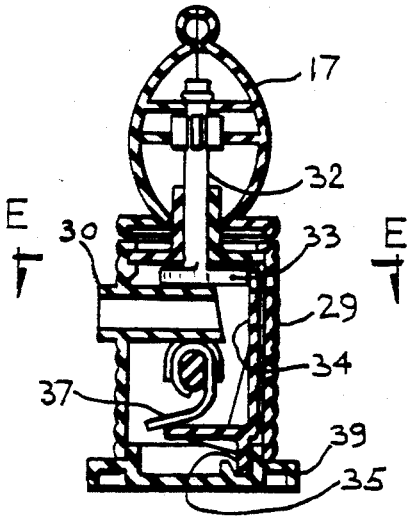
FIG. No. 49
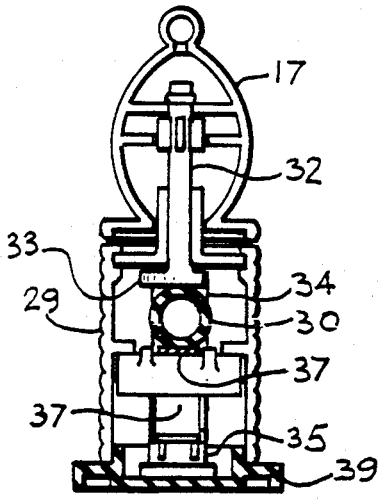
FIG. No.50

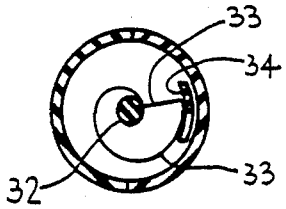
FIG. No. 51
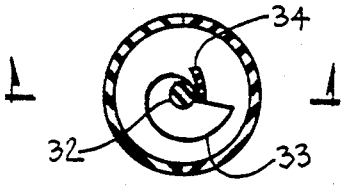
FIG. No. 52
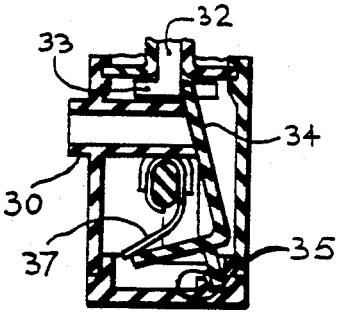
FIG. No. 53
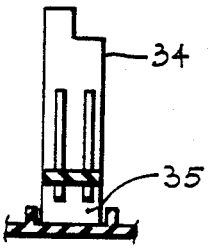
FIG. No. 53A
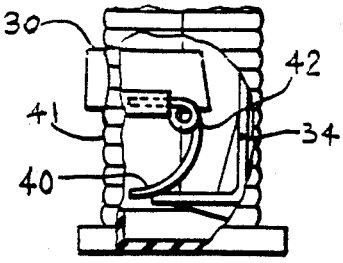
FIG. No. 53B
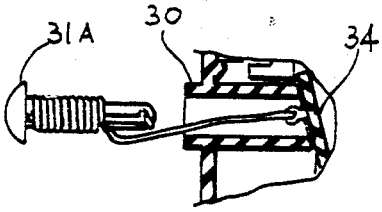
FIG. No. 53C

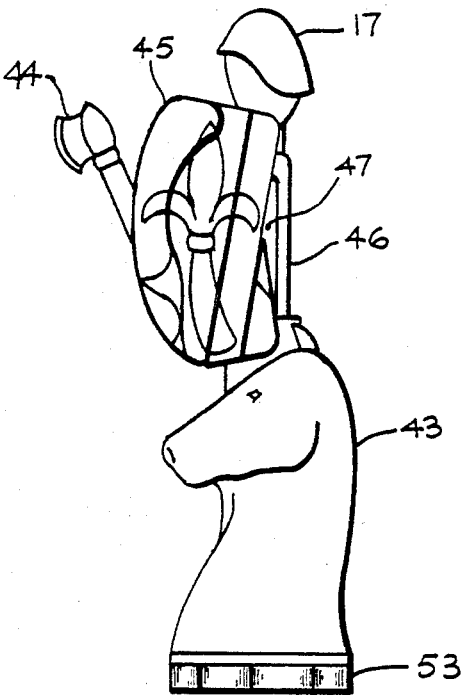
FIG. No. 54
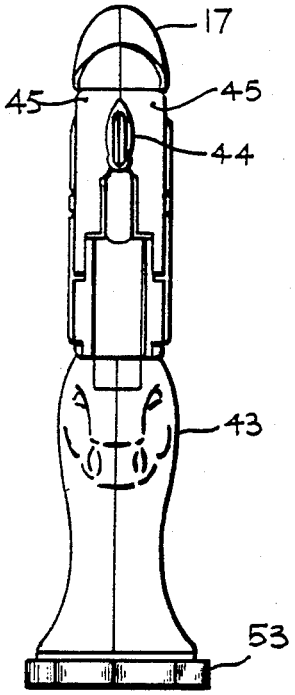
FIG. No. 55
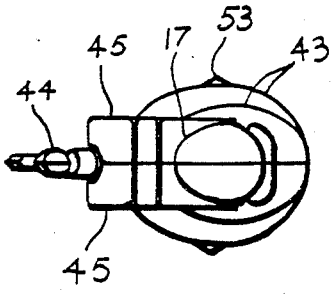
FIG. No. 56
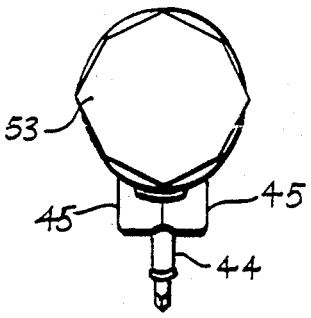
FIG. No. 57

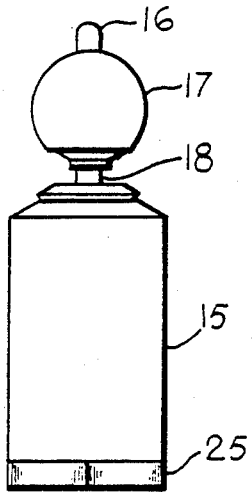
FIG. No.58
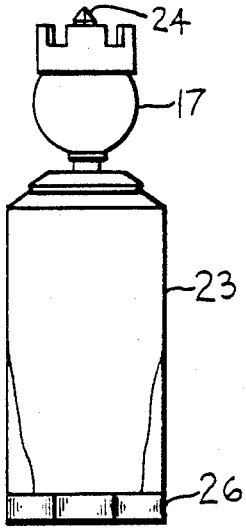
FIG. No.59
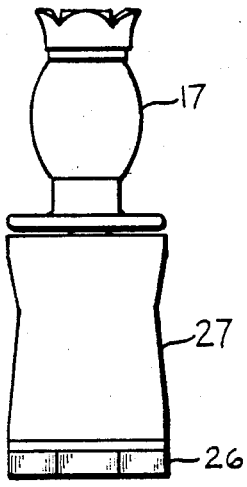
FIG. No.60
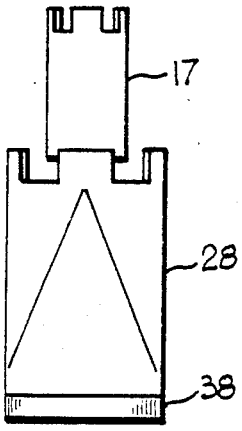
FIG. No.61
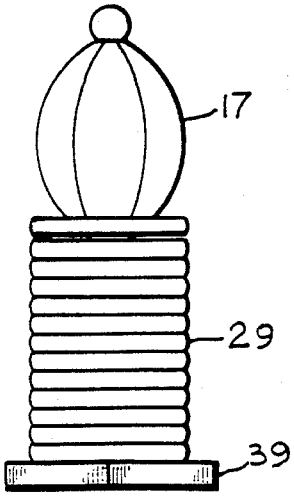
FIG. No.62
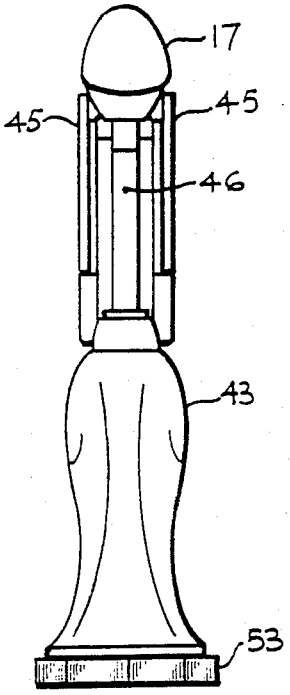
FIG. No.63

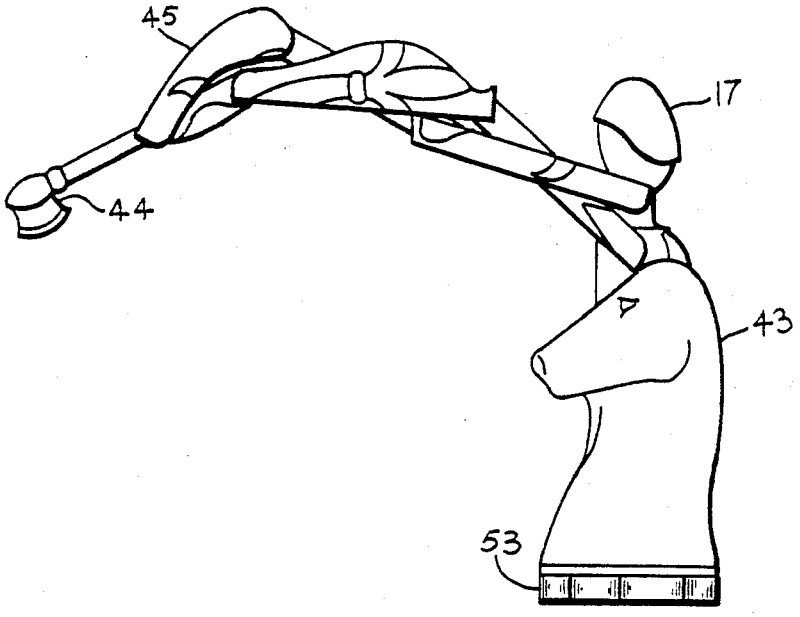
FIG. No. 64
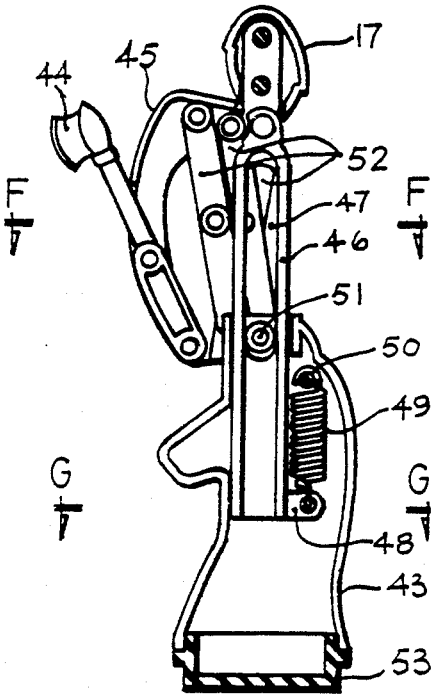
FIG. No. 65
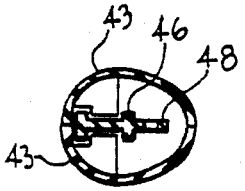
FIG. No. 66
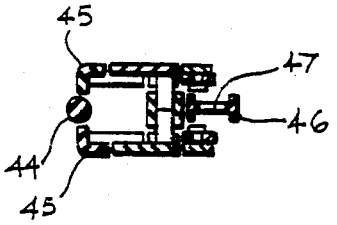
FIG. No.67

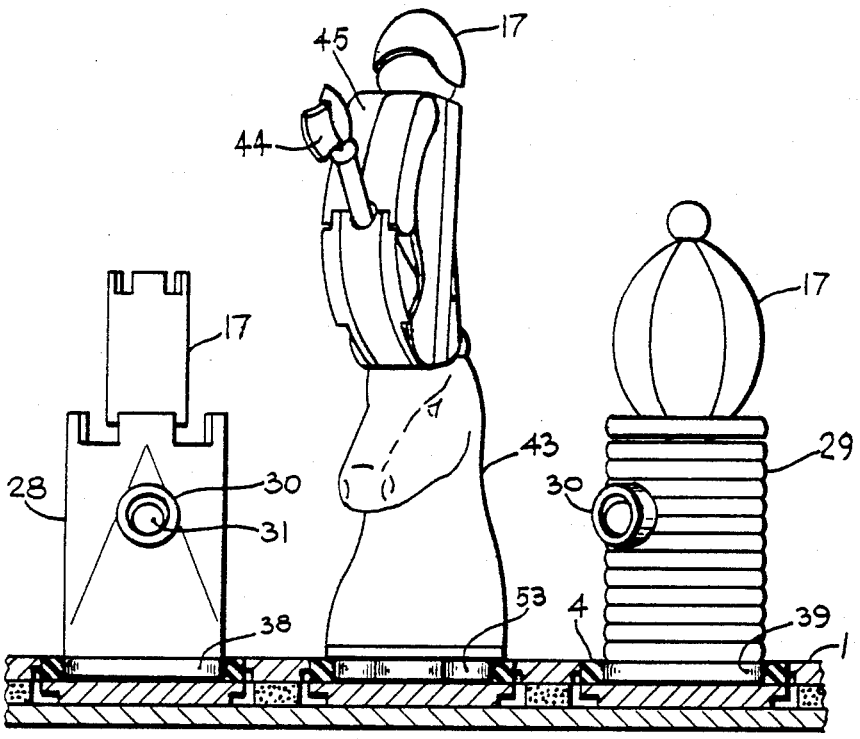
FIG. No. 68
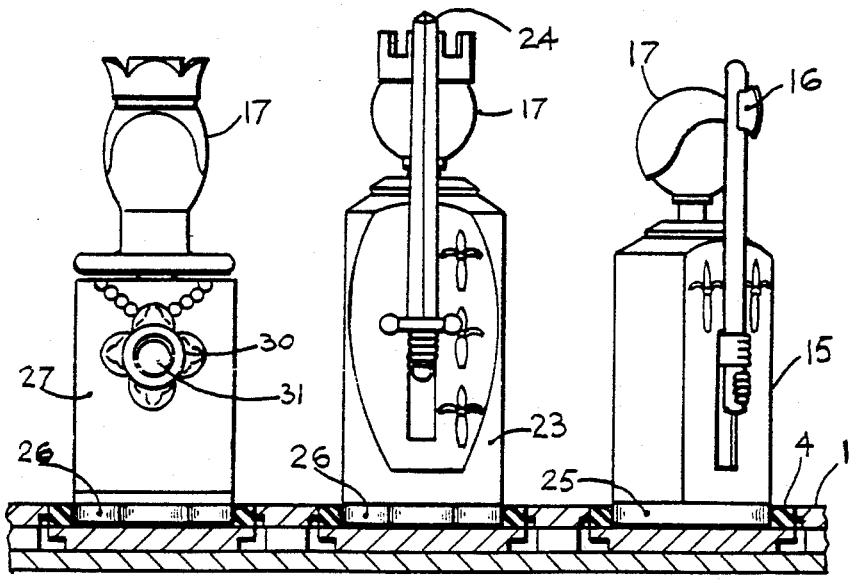
FIG. No. 69

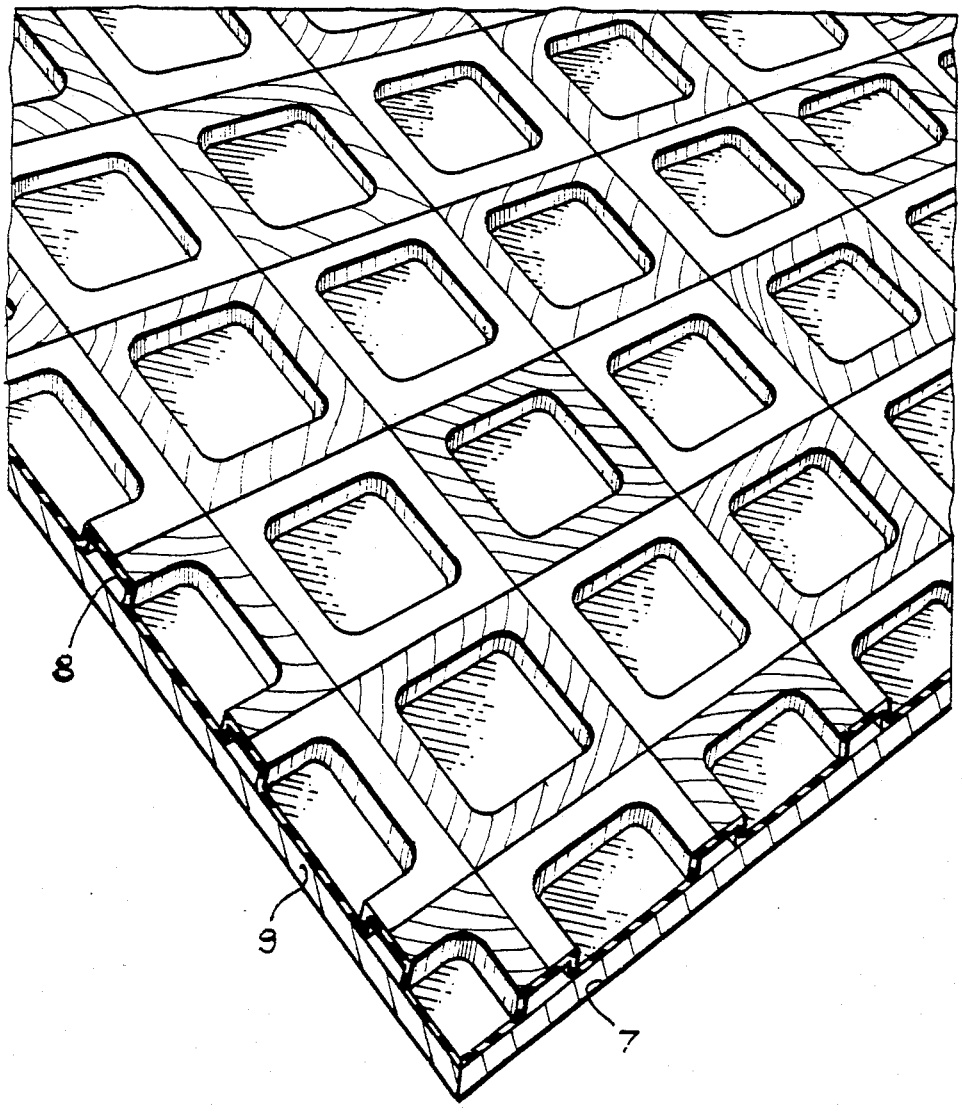
FIG. No. 70

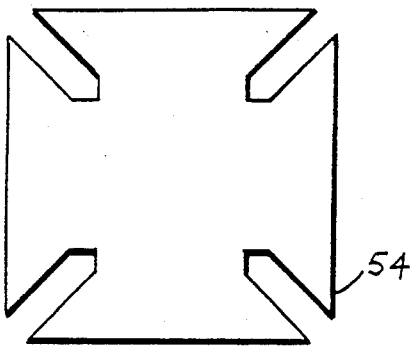
FIG. No.71
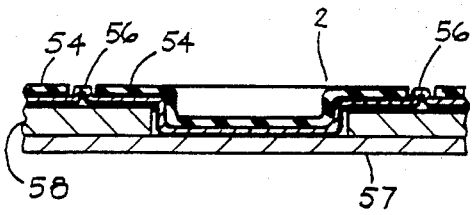
FIG. No.72
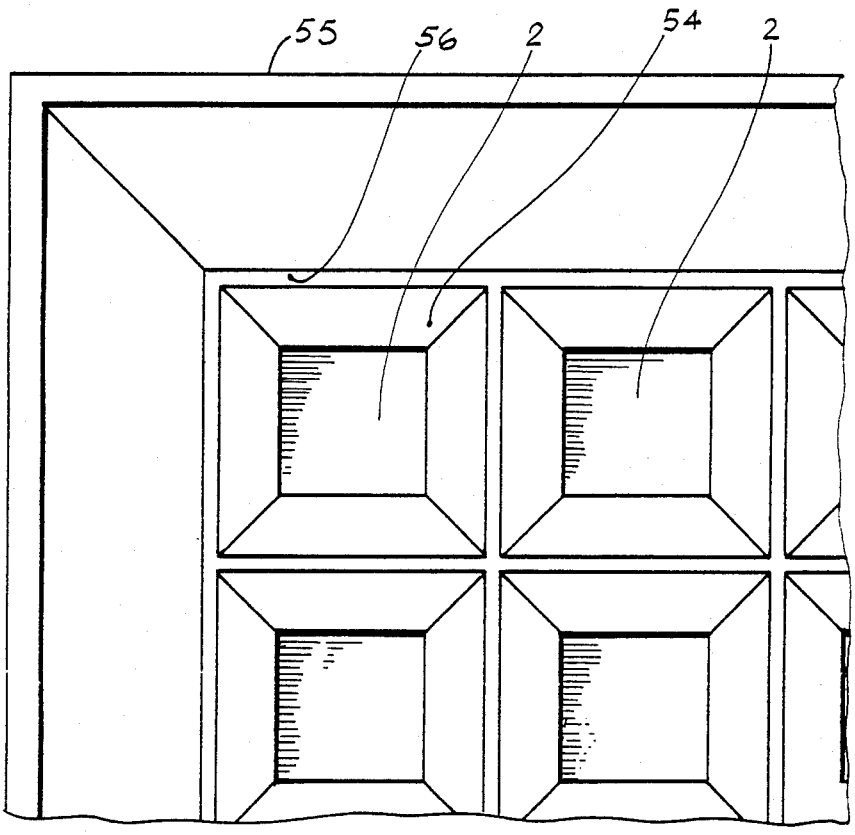
FIG. No.73

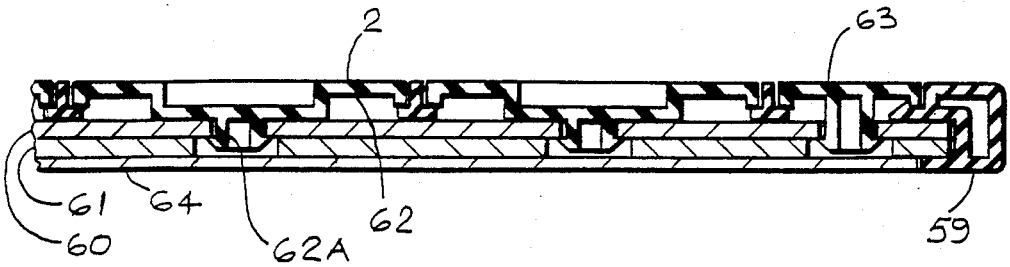
FIG. No. 74
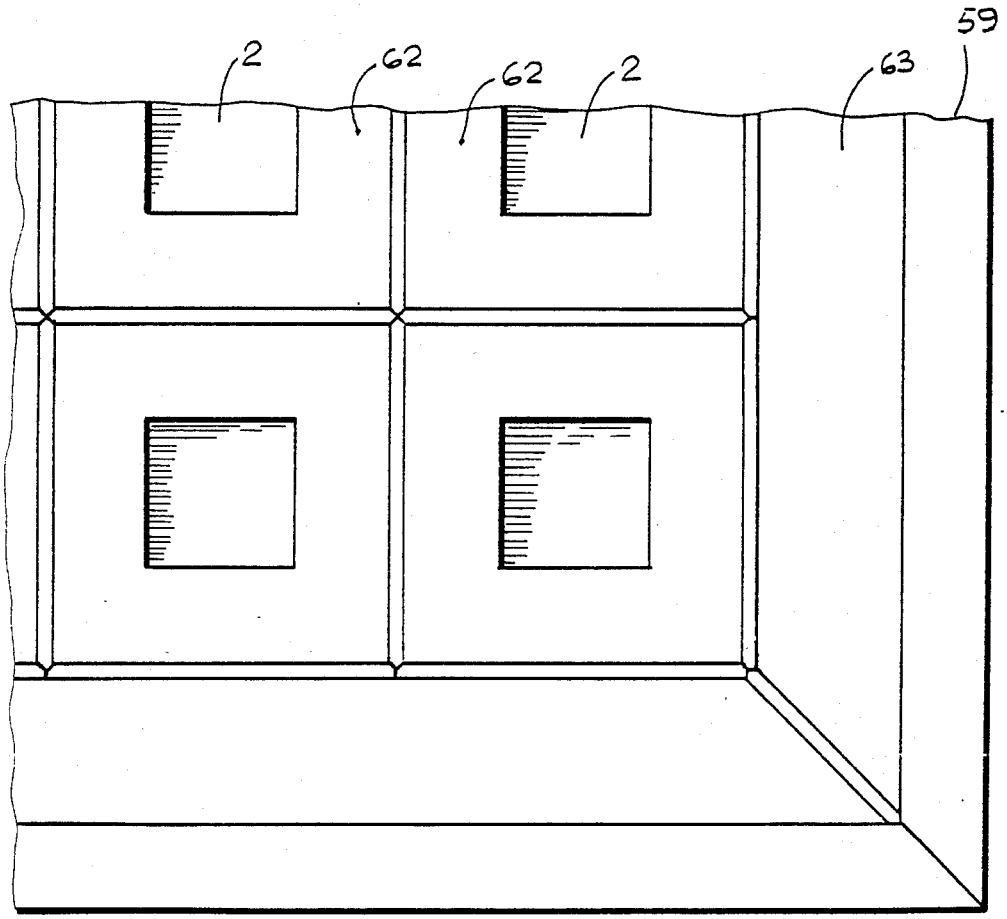
FIG. No.75

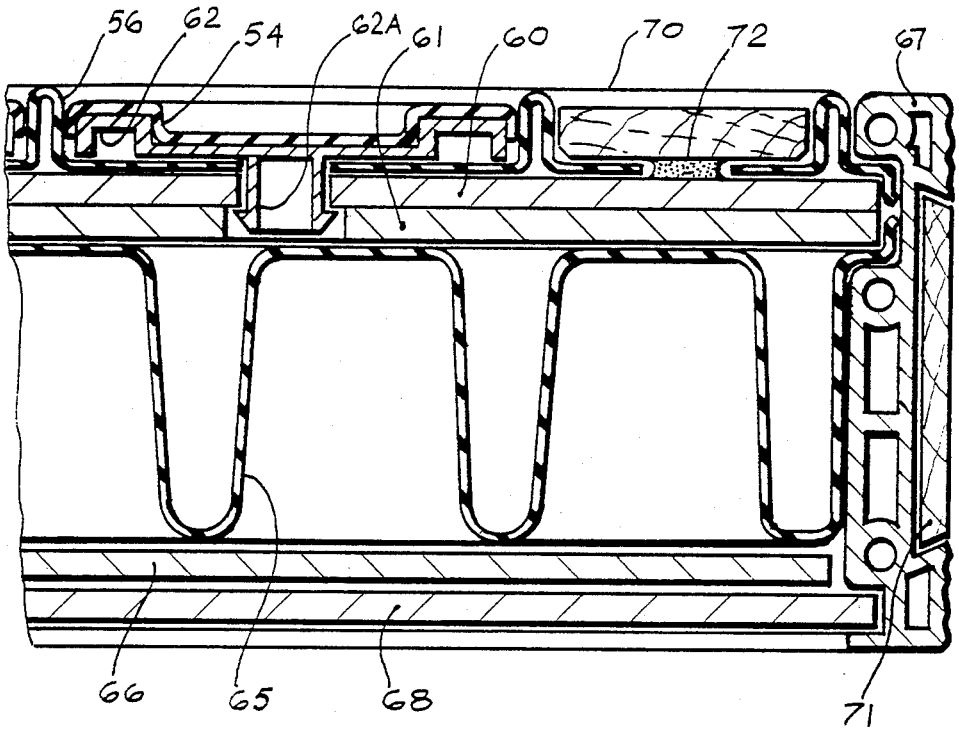
FIG. No.76

INSTRUCTIONAL CHESS GAME

This invention relates to the game of chess and seeks to provide improvements of a kind which do not change the basic appearance of the chess board, the basic appearance of the playing pieces or the rules of the game that has been known since antiquity. An object of the invention is to increase the visual interest of the game and to enable it to be more easily understood by young children and other learners of the game so that they will more quickly be able to play and enjoy chess than is usually possible when instruction is carried out employing only a conventional chess board and chess pieces.

The invention seeks to fulfil its objects by adding to the basically conventional way of playing the game an enhanced sense of excitement by incorporating into the playing pieces animation more or less corresponding to that which would have been expected in real life from knights, rooks/castles, kings, queens, bishops and pawns in earlier days when wars, and chess is a "war game", were more stylised and when leaders such as kings and modes of transport such as horses were of paramount importance.

Under present circumstances, employing conventional chess boards and playing pieces, players of the game must already have a knowledge of the rules and an ability to visualize the range and direction of influence of each playing piece. Thus, when playing chess with conventional game apparatus, the imagination of both players is of considerable importance in providing the excitement, pleasure and satisfaction in planning and implementing the various moves where different playing pieces "take" one another. The ability to visualize the danger of pieces being "taken" and the circumstances in which other pieces can do that "taking", sometime from relatively remote squares on the playing board, is not easily developed by all learners of the game, and particularly young children, when employing the relatively stationary and inactive playing pieces which form part of conventional chess game sets. Learners of the game, and especially young ones, need more visual imput from the playing pieces than is present in conventional chess sets to enable them to quickly and easily appreciate the relative importance of different playing pieces and the way in which, during a game, those playing pieces are used. The danger, and this is again particularly true of young children, is that the child or other person learning the game will become confused and bored by the relatively inactive playing pieces before becoming sufficiently advanced in the knowledge of conventional chess, thus mentally rejecting the game as being slow, boring, uninteresting and/or excessively intellectual whereas, if only the interest of the child or other learner could be maintained throughout the initial but relatively short and crucial period during which the allowed moves of the various pieces are being learnt, the child or other learner would soon find the game to be one of absorbing variety and interest thus in most cases becoming a life-long chess player and derive enjoyment and benefit for many years to come.

Features of the invention include providing the various chess pieces with animation effects such as the ability to launch projectiles, to swing swords, axes or other old fashioned weapons at opposing playpieces which, in accordance with the conventional chess game rules, on being struck are to be considered vanquished and therefore "taken". The translation of the mental concept of one inert piece attacking and vanquishing another inert piece into a real and visual action whereby the attacking play piece physically launches a projectile or directly strikes the piece which is to be taken largely substantially removes the intellectual aura of the game which in many cases prevents many children and other persons from taking up this most enjoyable and mentally stimulating pastime. Yound children are interested and amused by the physical attacks which the various pieces make upon one another and it is well known that a child who is interested and amused by the subject matter of the lesson will learn what is being taught by that lesson with little, if any, difficulty and without any resistance to learning.

A further object of the invention is to assist a child or other learner of the game in remembering the various moves of which different playing pieces are capable of in accordance with the rules. To this end, a chess set constructed in accordance with the invention incorporates an interdependent relationship between the bases of its playing pieces and the "squares" of the playing board. For instance, the base of a bishop play piece will not seat into any square of the playing board unless the bishop play piece is facing along, or in a direction parallel to, one of the two diagonals of the play board whereas the base of a rook/castle play piece will not seat into any square unless it faces in a direction parallel to one of the sides of the board. A knight will not seat into any square of the play board unless it is so positioned that, when activated to wield a weapon as herebefore mentioned, that weapon will strike a play piece at the opposite corner of a rectangle of six squares having sides of three and two squares. The physical relationship between the bases of the play pieces and the squares of the play board ensures that even a yound child or slow learner will relatively quickly understand the conventional rules which do not allow bishop play pieces to move in directions parallel to the board edges, rooks/castles play pieces to move diagonally about the board and the most difficult of all rules by which a knight can move only to the opposite corner square of a rectangle of six squares in a three by two squares configuration.

In view of the current world wide popularity of video games, that is to say, games in which both action and sound are re-produced on a domestic television set or a monitor screen from an electronic circuitry pack under the control of one or more players the invention also envisages the production of a "video" version of the game where the agressive actions of the play pieces are graphically displayed. Video chess games are already known but such games do not exhibit the instructional features that the present invention seeks to promote. It is proposed that a video chess game in accordance with the invention would show a board carrying representations of the traditional play pieces, these pieces being movable only in accordance with the conventional rules of the game of chess. A player would be able to choose the representational piece which is to be moved and, if no opposing piece was to be "taken", move that play piece to an unoccupied square of the representational play board to which the play piece rightfully can move. If, on the other hand, an opposing play piece is to be attacked and taken, prior to actually moving the play piece to the contmplated occupied square, the attacking play piece would fire a representational projectile, a laser gun or the like, or swing a weapon such as an axe, sword or lance, whereby on simulated contact the attacked play piece would collapse, disintegrate and/or explode and finally vanish from the screen with a suitably sutisfying explosive or electronic noise which could vary for each of the play-pieces roles. Eventually, the attacking piece would disappear from the square which it occupied prior to initiation of the attack and reappear in the square previously occupied by the "taken" and destroyed play piece. As in known video chess games, the circuitry pack would be programmed in such a way that each representational play piece would be able to move only to those squares allowed by the traditional rules of the game.

U.S. Pat. No. 3,627,324 discloses a chess set in which some of the playing pieces have bases which co-operate with the play board in allowing them to adopt only certain directional dispositions on the board when occupying any square, such pieces also carrying a designation indicating the permissible direction or directions in which the pieces can be moved from one square to another in accordance with the traditional rules of the game of chess. However, such a chess set, whilst being of undoubted assistance to a learner of the game, does not include the agressive animation of the playing pieces which is provided in accordance with the present invention and which is of major importance in dispelling the intellectual aura of the game for older learners and providing visual interest for the younger learners. Generally speaking, it is only in indoor game apparatus of the kind which seeks to reproduce, as far as possible, an outdoor game such as football, basketball or the like in which the playing pieces are constructed to project, by simulating kicking or throwing, projectiles, simulating footballs or the like, towards one another, British Patent Specification No. 1299619 being a good example disclosing such game apparatus. It will immediately be realised, however, that the apparatus of this kind is in no way analagous to the agressively animated playing pieces that are provided in a chess set constructed in accordance with the present invention.

According to one aspect of the invention, there is provided a chess set comprising an eight-by-eight square playing board and two sets of visually distinct playing pieces each comprising eight pawns, two knights, two bishops, two rooks/castles, one queen and one king, characterised in that each playing piece is animated in such a way as to be operable by a player to cause it to physically attack an opposing playing piece that is to be "taken" during a move of the game, and characterised in that the bases of the playing pieces and the squares of the board have an interdependent co-operating relationship which is such that at least the knights, bishops, rook/castles, queens and kings will not establish the cooperating relationship with any squares of the board when facing in a direction that is unallowable in accordance with the traditional rules of the game of chess.

For a better understanding of the invention, and to show how the same may be carried into effect, reference will be made, by way of example, to the accompanying drawings, in which:

FIG. 1 illistrates a partial plan view of the play board surface.

FIG. 2 illustrates a partial plan view of the rear grooved surface configuration of the upper panel component of the play board.

FIG. 3 illustrates a partial plan view of the latticed configuration of the intermediate panel component of the play board.

FIG. 4 illustrates the typical side elevation view of the square annular holes liner component of the play board as seen from any one of the four sides.

FIG. 5 illustrates the top plan view of the square annular hole liner component of the play board.

FIG. 6 illustrates the bottom plan view of the square hole annular liner component of the play board.

FIG. 7 illustrates a cross sectional view about plane A—A of FIG. 5.

FIG. 8 illustrates a partial view of the rear grooved surface of the play board laminate upper panel laminar component showing the square annular hole liners assembled in position inside the panel latticed configuration square holes.

FIG. 9 illustrates a partially cut away perspective view of one corner of the playing board showing its components and mode of construction in accordance with one mode of implementation of the invention.

FIG. 10 illustrates a typical cross sectional view of the play board panel.

FIG. 11 illustrates a longitudinal partial sectional elevation view illustrating the incorporation of the playing board into a box which will hold the playing pieces of the chess set.

FIG. 12 illustrates a lateral cross sectional partial view of the play board as incorporated in the framework of a box configuration with a sliding lid panel and internal partition panels which form receptacles for the storage of the playing pieces of the chess set.

FIG. 13 illustrates a composite cross sectional view of the play board panel and of the surrounding box frame of plastic moulded sides and corner moulding as would be seen nearer a corner of the play board and box assembly.

FIG. 14 illustrates a typical cross sectional view of the sides of the box as would be made of wood and showing the dowel holes for the connection of the box corner mouldings to the box sides intersecting the holes provided for locking dowel plugs.

FIG. 15 illustrates in a partial perspective view further constructional details of the box illustrating the mode of assembly of the playboard panel, the box sides, the box corner mouldings and the external outline of the intersecting interlocking dowel plugs.

FIG. 16 illustrates the full front elevation view of a pawn play piece of the chess set.

FIG. 17 illustrates a mid-plane lateral cross sectional view of the pawn play piece and showing the configuration of the internal actuating mechanism of the pawn pieces of the chess set.

FIG. 18 illustrates a top plan view of the pawn play piece illustrated in FIG. 16.

FIG. 19 illustrates the underneath plan view of the base of the pawn play pieces of the chess set in the orientation as illustrated in FIG. 17 and 21.

FIG. 20 illustrates a mid plane frontal cross sectional elevation view of the pawn play piece showing the configuration of the internal actuating mechanism.

FIG. 21 illustrates the side elevation view of the pawn play piece as correspondingly illustrated in FIGS. 16 to 20.

FIG. 22 illustrates the front elevation view of the king play piece of the chess set.

FIG. 23 illustrates the side elevation view of the king play piece as illustrated in FIG. 22.

FIG. 24 illustrates the top plan view of the king play piece as illustrated in FIG. 22.

FIG. 25 illustrates the underneath plan view of the king play piece as illustrated in FIGS. 22 and 23.

FIG. 26 illustrates the mid-plane frontal cross sectional elevation view of the king play piece showing the configuration of the play piece internal actuating mechanism.

FIG. 27 illustrates the mid-plane lateral cross sectional elevation view of the king play piece showing the configuration of the play piece internal actuating mechanism.

FIG. 28 illustrates a cross sectional plan view of the lower body of the king play piece about plane D—D as shown in FIG. 27.

FIG. 29 illustrates a mid-plane front elevational cross sectional view of the king playpiece about plane E—E as shown in FIG. 28.

FIG. 30 illustrates a plan cross sectional view of the pawn play piece about plane B—B as shown in FIG. 17.

FIG. 31 illustrates a full side elevation view of the king playpiece as similarly shown in FIG. 23 but here shown in an attacking attitude after being actuated by depressing the king's play piece head which causes the sword, its frontal weapon, to be extended forward and downward toward its opponent playpiece until it is struck by the sword.

FIG. 32 illustrates a full side elevation view of the pawn playpiece as similarly shown in FIG. 21 but here shown in an attacking attitude after having been actuated by way of the depressing of the pawn play piece's head which causes the axe, its frontal weapon, to be extended forward and downward toward its opposing play piece until it is struck by the axe.

FIG. 33 illustrates the queen play piece in a full front elevation view.

FIG. 34 illustrates the full lateral elevation view of the queen play piece as illustrated in FIG. 33.

FIG. 35 illustrates the top plan view of the queen play piece as illustrated in FIG. 33.

FIG. 36 illustrates the underneath plan view of the queen play piece as illustrated in FIG. 33.

FIG. 37 illustrates a mid-plane front elevational cross sectional view of the queen play piece correspondingly illustrated in FIG. 33.

FIG. 38 illustrates a mid plane lateral cross sectional elevation view of the queen play piece correspondingly illustrated in FIG. 34.

FIG. 39 illustrates the full front elevation view of the rook/castle play pieces of the chess set.

FIG. 40 illustrates the full lateral elevation view of the rook/castle play piece correspondingly illustrated in FIG. 39.

FIG. 41 illustrates the top plan view of the rook/castle play piece as shown in FIG. 39.

FIG. 42 illustrates the bottom plan view of the rook/castle play piece as shown in FIG. 40.

FIG. 43 illustrates the mid-plane cross sectional side elevation view of the rook/castle play piece shown with its actuating mechanism cocked and ready to be released on activation by way of the rotation of the upper rotatable element of the play piece.

FIG. 44 illustrates the mid-plane cross sectional front elevation view of the rook/castle play piece correspondingly shown in FIG. 39.

FIG. 45 illustrates the full side elevation view of the bishop play piece of the chess set.

FIG. 46 illustrates the full front elevation view of the bishop play piece as shown in FIG. 45.

FIG. 47 illustrates the underside plan view of the bishop play piece illustrated in FIG. 45.

FIG. 48 illustrates the top plan view of the bishop play piece as shown in FIG. 46.

FIG. 49 illustrates the mid-plane lateral cross sectional elevation view of the bishop play piece as shown in FIG. 45.

FIG. 50 illustrates the mid-plane frontal cross sectional elevation view of the bishop play piece as shown in FIG. 46.

FIG. 51 illustrates the plan cross sectional view about plane E—E as shown in FIGS. 38,43 and 49 of the queen, rook/castle and bishop play pieces respectively showing the projectile launcher or cannon cam loading-triggering device cocked and ready to be discharged.

FIG. 52 illustrates the plan view about plane E—E as described for FIG. 51 but showing the cam operated triggering device turned clockwise past the firing position thus showing the projectile ejecting spring powered level at its end-travel and spent position.

FIG. 53 illustrates the partial mid-plane lateral cross sectional elevation view of the lower portion of the bishop play piece and similarly of the queen and castle/rook playpieces whereby a leaf type of spring powered triggering device is incorporated, in place of a coil spring device, and is shown in its end-travel, spent attitude.

FIG. 53A illustrates the mid-plane cross sectional frontal elevation view of the "L" shaped projectile propelling lever which is shown as being a component of the projectile propelling mechanism illustrated in FIGS. 37,38,43,44,49,50,51 and 53.

FIG. 53B illustrates the mid plane lateral partial cross sectional elevation view of the lower portion of the bishop play piece and similarly applicable to the queen and castle/rook play pieces in which the actuation mechanism actuating spring incorporates two lateral coils interconnected by crescent shaped extensions and which is fitted directly into the play pieces front half of the play pieces body moulding, the spring and propelling lever being shown at the "ready to fire" attitude.

FIG. 53C illustrates a projectile fired from a bishop, queen or castle/rook playing piece.

FIG. 54 illustrates the full side elevation view of the knight play piece with its weapon in the fully retracted attitude.

FIG. 55 illustrates the full front elevation view of the knight play piece correspondingly illustrated in FIG. 54.

FIG. 56 illustrates the top plan view of the knight play piece as shown in FIG. 54.

FIG. 57 illustrates the underneath plan view of the knight play piece as shown in FIG. 55.

FIG. 58 illustrates the full back elevation view of the pawn play piece of the chess set.

FIG. 59 illustrates the full back elevation view of the king play piece of the chess set.

FIG. 60 illustrates the full back elevation view of the queen play piece of the chess set.

FIG. 61 illustrates the full back elevation view of the rook/castle play piece of the chess set.

FIG. 62 illustrates the full back elevation view of the bishop play piece of the chess set.

FIG. 63 illustrates the full back elevation view of the knight play piece of the chess set.

FIG. 64 illustrates the full side elevation view of the knight play piece in the attacking attitude after full activation whereby the knight play piece rider's head on being fully depressed causes the shield and weapon extendible and telescopic mechanism to extend fully into the striking attitude.

FIG. 65 illustrates the mid-plane lateral cross sectional elevation view of the knight play piece in its fully retracted attitude, as shown in FIG. 54, illustrating the knight play piece actuating mechanism.

FIG. 66 illustrates the plan cross sectional view of the horse's neck of the knight play piece about plane G—G as shown in FIG. 65.

FIG. 67 illustrates the plan cross sectional view of the shield and weapon components of the knight play piece about plane F—F as shown in FIG. 65.

FIG. 68 illustrates a typical cross sectional partial view of the play board panel showing the typical appearance of the castle/rook, knight and bishop play pieces positioned in the square depressions in the play board surface and in general alignment as at the commencement of a game, the castle/rook playpiece being capable of striking in four directional attitudes, the knight play piece being capable of striking in eight directional attitudes and the bishop play piece being capable of striking in four directional attitudes, all as determined by the configuration of the play pieces basal configuration and in accordance with the rules of the game of chess.

FIG. 69 illustrates a typical cross sectional partial view of the play board showing the typical appearance of the queen, king and pawn playpieces positioned in the square depressions in the play board surface and in general alignment as at the commencement of a game, the queen and king playpieces being each capable of striking in eight directional attitudes whilst the pawn play pieces are capable of striking in four directional attitudes of which two backward attitudes are not permitted by the rules of the chess game whilst all the other striking attitudes as described for the play pieces are in accordance with the rules of the game of chess.

FIG. 70 illustrates an alternative mode of construction for the play board and as shown is a partial perspective view of the play board.

FIG. 71 illustrates the developed plan configuration of a flexible liner of a play board square as would be fitted in the construction of an alternative play board having the play board squares lined with real or simulated leather.

FIG. 72 illustrates a typical cross sectional view of a section of the play board which is constructed so as to accomodate the fitting of real or synthetic leather liners into the play board squares.

FIG. 73 illustrates a typical partial plan view configuration of a corner of the alternative play board which is so constructed as to accomodate the fitting of real or synthetic leather into the play board squares and borders.

FIG. 74 illustrates a typical partial cross sectional view of a section of an alternative play board which is so constructed as to accomodate on its upper surface injection moulded squares, contrasting play square borders inserts and play area borders inserts.

FIG. 75 illustrates a typical partial plan view configuration of a corner of the alternative play board corresponding to the cross sectional view illustrated in FIG. 74.

FIG. 76 illustrates a typical cross sectional partial view of a alternative play board construction as incorporated in a box configuration which incorporates a moulded tray to provide storage pockets for the play pieces, this particular configuration being a composite of plastic injection moulded, extruded and vacuum formed components which further incorporate real or synthetic leather liners for the play board squares and wood inserts for the play board sides and box sides.

In further detail and referring to the accompanying drawings, and firstly to FIGS. 1,2,3,4,5,6,7,8,9 and 10 a playboard (1) is square and comprises of sixty four smaller playing squares (2) arranged in an eight-by-eight relationship and with alternate squares in both directions that are parallel to the outer edges of the board finished in contrasting colours that may conventionally, but not essentially, be black and white. In fact, the board that is illustrated in FIG. 1 has a laminated construction comprising three layers preferably, but not essentially, include good quality wood veneers. An upper layer (3) of the complete board may be formed from a single veneer through which are cut sixty-four square openings receiving a liner (4) that hides the otherwise exposed cut edges of the corresponding opening. The liners (4) may be made from a synthetic plastic material and alternate liners are given contrasting colours in both directions that are parallel to the outer edges of the board, these colours conventionally, but not absolutely essentially, being black and white. Contrasting wood colours could be used but an alternative and, if preferred, the liners (4) could be formed from wood instead of a synthetic plastic material.

The board that is illustrated in FIGS. 1 to 10 inclusive is made by firstly cutting the square upper layer (3) from a selected good quality veneer wood panel, or if preferred, the upper layer (3) can be made in sixty-four separate pieces for assembly to give two alternate contrasting wood colours in both directions that are parallel to the edges of the board (1). A bottom or supporting layer (6) is then cut exactly to the required square size, being formed from plywood or any other solid material of sufficient rigidity that is suitable for the purpose. A second or intermediate layer (5) is accurately cut to the required size and may be formed from cardboard, plywood or a rigid grade of expanded polystyrene, the layer (5) being of the same thickness as the upper layer (3). The previously mentioned sixty-four square openings, having rounded corners, are initially formed in the upper layer (3) by producing die cuts through part of the thickness of that layer (3). The further manufacture of the board (1) is accomplished by making die cuts to remove the sixty-four pieces from the upper layer (3) that correspond to the sixty-four openings therethrough, glueing them to the bottom panel (6) in corresponding openings formed in the second layer (5) and glueing the whole assembly of layers (3), (5) and (6) together plus the liners (4) and the pieces that have been excised from the playing squares (2) of the upper layer (3) and transferred into the openings in the second layer (5). A system of die cut grooves of which some can be seen in FIG. 9 of the drawings assist in maintaining all the component parts in their appointed positions during a curing step in a curing press which step hardens the glue by which the said parts are connected to one another. When the board (1) is to fit a framework to form part of a box for the playing pieces, no finishing of the board edges is required but, in other cases, the board edges may be covered with veneer or timber mouldings as would be expected in a high quality chess board. If, as is preferred, the upper layer (3) is formed from a single piece of good quality natural or veneered wood, the upper surface of the board gives a pleasing undisturbed continuity of wood grain appearance, the sixty-four openings in the upper layer (3) being edged by the appropriately alternative coloured liners (4).

FIG. 70 of the drawings illustrates an alternative form of playing board (7) that is less expensive to produce than is playing board (1). The board (7) of FIG. 70 comprises a vacuum formed and appropriately colour printed plastics sheet (8) which sheet (8) is secured by an adhesive to the surface of a substantially rigid supporting panel (9) formed from cardboard or other suitably rigid material. In order to prevent deformation of the platics formed sheet (8) by accidental crushing, the lattice of hollow spaces between that sheet (8) and the supporting panel (9) may be filled with either a latticed intermediate panel or by strips of, for example, polystyrene or cardboard which fill the otherwise empty hollow spaces and provide adequate resistance to normal crushing and flattening forces.

Other forms of playing boards are possible such as, for example, a unitary moulded construction in which the traditional black and white playing squares are printed onto the upper surface of the panel prior to, or after, the moulding of the sixty four openings therein that correspond to the sixty four playing squares of the board. Turning now to FIGS. 11,12,13,14 and 15 of the drawings, it can be seen that the previously described playing board (1) may form the upper surface or lid of a box (10) that is arranged to contain all thirty-two of the playing pieces. In addition to the lid or cover afforded by the playing board (1) the box (10) comprises opposed side walls (11), a bottom (12), end walls (13) and dividers 14 which co-operate with vertical slots in the side walls (11) to partition the interior of the box (10) into 32 different compartment, one compartment to each playing piece.

FIGS. 16,17,18,19,20,21,32,58 and 69 illustrate details of the construction and appearance of a pawn play piece (15). The pawn wields an axe (16) as would be appropriate for a foot soldier of past ages but other old fashioned weapons may be substituted, if preferred. The head (17) of the pawn wears a simple helmet and is carried by an upwardly and downwardly moveable shaft (18) having an abutment (19) at its lower end which abutment bears against an arm member (20) that carries the axe (16). The arm member (20) is turnable about a pivot (22) and bears against one arm of a spring (21). Upon pressing downwardly on the head (17) of the pawn (15), the abutment (19) will force downward and turn the arm member (20) in an anti-clockwise direction (as seen in FIG. 17) about the pivot (22) against the action of the spring (21), thus causing the axe (16) to strike downwardly against any playing piece occupying the adjoining playing square (2) faced by the pawn (15). To enable the pawn play piece to return the alignment of the pawn's head forward the moveable shaft (18) and its guiding sleeve retain a cross section other than round, such as for example a square cross section, which does offer resistance to the turning of the shaft (18) in its guiding sleeve. FIG. 30 specifically illustrates the 45 degrees alignment of the pawn play piece basal configuration relative to the pawn upper body.

FIGS. 22,23,24,25,26,27,28,29,31,59 and 69 show a king playing piece (23) whose construction and operation is very similar indeed to that of the pawn (15) but, in the case of the king (23), the arm member (20) carries a sword (24) or other superior hand weapon that is appropriate to the leader of the "black" or "white" playing pieces. FIG. 31 of the drawings shows the king (23) in an attacking attitude, the head (17) of the king having been depressed by the finger of a player to cause the sword (24) to swing forward and downward until it strikes an opposing playing piece occupying any adjoining square faced by the king. FIGS. 19 and 25 of the drawings are underneath plan views of the pawn (15) and the king (23) respectively. It can be seen in FIG. 19 that the pawn (15) has a swuare base (25) whereas FIG. 25 shows that the king (23) has an octagonal base (26). The pawn (15) faces one of the corners of the square base (25) and it will be apparent that the said square base (25) will only fit in the recess of any one of the playing squares (2) of the board (1) with said pawn facing towards one of the corners of that square (2). Since, according to the rules of chess, a pawn can only take an opposing piece by moving one square diagonally forwards, it will immediately be apparent that the base (25) of the illustrated pawn (15) will only fit in the recess of any one of the playing squares (2) in one of four different positions. Two of these positions are ones in which the pawn (15) faces diagonally forwards and a learner of the game will immediately recognise that the appropriate position for taking an opposing piece is one in which the pawn (15), and thus its axe (16), faces the piece that is to be taken in a diagonally ahead and adjoining square (2). It is very basic to the game of chess thato pawns advance from one side of the board to the other, where they can be promoted to either a queen or a knight, and it will be a very slow learner indeed who will not almost immediately appreciate that the pawns (15) should never face diagonally rearwards. The octagonal base (26) of the king (23) enables the king (23) to fit in the recess of any one of the playing squares (2) in an attitude in which it can face any chosen one of the eight (or less if it is at an edge or a corner of the board) immediately adjoining playing squares (2).

Each queen playing piece (27) (illustrated in FIGS. 33, 34,35, 36,37,38,60 and 69), each rook/castle playing piece (28) (illustrated in FIGS. 39,40,41,42,43,44,61 and 68) and each bishop playing piece (29) (illustrated in FIGS. 45,46,47, 48,49,50,62 and 68) can, according to the rules of chess, attack any opposing piece that is at any distance therefrom on the board (1), provided only that no other piece intervenes in a direct straight line between the attacking piece and the opposing playing piece. Queen play pieces may move any distance in any direction in a straight line, rook/castle play pieces may move any distance in a straight line that is parallel to one of the edges of the board (1) and bishop play pieces may move any distance in a straight line along a diagonal of the board (1) or in a direction that is parallel to one of the two diagonals of the board. This being the case, it is not appropriate for these playing pieces directly to strike opposing pieces that are to be taken and, instead, each of them incorporates a projectile launcher or cannon (30) in the form of a horizontally disposed tube of circular or other similarly effective cross section whose delivery end projects from the front of the playing piece in question. Each cannon (30) is arranged to propel a substantially cylindrical projectile (31) (FIGS. 43,44,37,38) having rounded ends, it being desirable that the projectiles (31) should be reversible and, for safety reason, that they should be light in weight and should have no sharp points or edges. The projectiles (31) can readily and inexpensively be produced from synthetic plastic materials such as expanded polystyrene and others.

In the examples that are being described, the projectiles propelling devices are actuated by springs and reference is additionally made, in this connection to FIGS. 51,52,53 and 53B of the drawings. The head of each playing piece, queen (27), rook/castle (28) and bishop (29), is rotatable about a substantially vertical axis afforded by a corresponding shaft (32), each such shaft (32) carrying, at its lowermost end and internally of the playing piece concerned, a horizontally disposed cam (33) whose shape and function can be seen best in FIGS. 51 and 52. Upon using the head of one of the playing pieces (27),(28) or (29) to rotate the shaft (32) and thus the cam (33), said cam will turn a "L" shaped lever (34) about a horizontal pivot (35), that is defined beneath its lower horizontal limb by the co-operation of a rib and a recess in the base of the playing piece body, against the action of a helical compression spring (36), FIGS. 36, 37, 43 and 44, or a leaf spring (37), FIGS. 49,50 and 53, or a wire/coil combination spring (40), FIG. 53B. The springs (36),(37) and (40) bear downwardly upon the upper surfaces of the lower horizontal limbs of the "L" shaped levers (34) and thus tend to turn those levers in an anti-clockwise directions, as illustrated, about the corresponding pivots (35) as seen in FIGS. 38,43,49 and 53 of the drawings. Upon compression of the spring (36) or (37) or (40) by rotating the head of the corresponding piece, a player does insert one of the projectiles (31) into the cannon (30) so that a "ready to fire" or cocked position, approximately as illustrated in FIGS. 38,43,49 and 51 is reached. Upon turning the cam (33) angularly a few degrees further in a clock-wise direction as seen in FIG. 51, the curved edge of the cam will lose contact with the upright limb of the "L" shaped lever (34) so that the spring (36) or (37) or (40) will snap the lever (34) to substantially the position shown in FIG. 53, its upright limb causing the lightweight projectile (31) that had occupied the cannon (30) to be projected horizontally from the mouth of that cannon for a sufficient distance to strike an opposing playing piece even if that playing piece should be at the opposite corner of the playing board from the position of the attacking piece and thus at the greatest possible distance therefrom that would ever be required. All that is necessary to cause the same playing piece to fire another projectile (31) is to rotate the head of the playing piece through a little less than 360 degrees about the vertical axis of the shaft, thus also realigning the head of the play piece to face directly ahead, at which point the cannon (30) can be reloaded with another projectile (31) thus regaining substantially the position shown in FIGS. 38,43 and 51.

If desired, each bishop (29), rook/castle (28) and queen (27) may be provided with its own individual projectile (31A), the latter being connected to the interior of the corresponding cannon (30) by a piece of light cord, string or the like having a length a little greater than the maximum distance which the projectile (31A) will have to travel to reach its target, the connecting length of material being wound about the shank of the projectile (31A) as shown in FIG. 53C. This substantially eliminates the likelihood of loss of the projectiles (31A) and still further reduces the already small danger of injury being caused thereby.

Since the queen (27) play piece can move in any straight direction from any playing square (2) which it occupies, it has the same octagonal base (26) as does the king (23). The rock/castle (28), on the other hand, can move only in directions that are parallel to the edges of the playing board (1) and accordingly has a square base (38) which is so orientated with respect to the front of the rook/castle (28) (i,e. the side thereof from which the delivery end or mouth of the cannon (30) projects) the said front will essentially face in a direction parallel to one of the edges of the playing board (1) when the base (38) fits in the recess of any playing square (2).

The bishop (16) can move only along diagonals of the playing board (1) or in directions parallel to either diagonal and accordingly has a square base (39) which is so orientated with respect to the "front" of the bishop (29) (again the side of the bishop (29) from which the delivery end or mouth of the corresponding cannon (30) projects) that, when said base (39) is fitted in the recess of any one of the playing squares (2), the bishop (29) will essentially be facing in a direction that is at 45 degrees to any edge of the square playing board (1).

FIG. 53B of the drawings illustrates an alternative to the use of the leaf spring 37 shown in FIGS. 49,50 and 53. In FIG. 53B, a resilient wire spring (40) has its opposite ends fixed in two anchorages (41) that extend horizontally inside the front half of the playing piece body. The ends of the wire spring (40) which are received in the anchorages (41) merge into aligned horizontal coils (42) and the opposite ends of these two coils are integrally connected by a loop which bears downwardly against the free end of the substantially horizontal limb of the lever (34) thus acting in the same way as the springs (36) and (37) in tending to turn the lever (34) in an anti-clockwise direction about its pivot (not visible in FIG. 53B) to propel one of the projectiles (31) when the lever (34) is suddenly released by the cam (33).

FIGS. 54,55,56,57,63,64,65,66,67 and 68 of the drawings illustrate an equestrian knight playing piece (43) which playing piece (43) is again of the kind whose animation is arranged to enable the knight directly to strike an opposing playing piece which it is to take. It will be remembered that the rules of chess allow a knight to move only to the diagonally opposite corner of any rectangle of six playing squares (2) whether or not there are any other playing pieces between the knight playpiece and the opposing playpiece that is to be taken. The knight (43) wields, by way of example, an axe (44) and a shield (45), these parts (44) and (45) being members of an asymmetrical "lazy tongs" device which is operable to bring the knight from the rest position shown in FIGS. 54 and 65, more clearly, to the striking or attacking position shown in FIG. 64 by using finger pressure to push the head of the knight downwardly towards the body of the horse. To this end, the top and front of the horse portion of the equestrian knight (43) afford a guideway into which a slider (46) formed with an elongated slot (47) is downwardly movable, the upper end of the slider (46) carrying the head of the helmeted knight (43). The lower end of the slider (46) carries a lug (48) and a helical tension spring (49) which is stretched between the lug (48) and an anchorage pin (50) in an upper rear portion of the body of the horse. A stop pin (51) extends transversely through the slot (47) in the slider (46) and prevents movements of that slider (46) beyound positions at which the pin (51) bears against one or the other end of the slot (47). The stop pin (51) also acts as a pivot pin of the "lazy tongs" device and it will be seen from FIGS. 64 and 65 of the drawings of the said device comprises pairs of crossed links (52) that are successively pivotally interconnected at their upper ends and at their lower ends and at the points at which they cross one another. The axle (44) is an extension of the outermost link of this device and the greater part of the shield (45) affords a further link thereof. When the finger of a player presses downwardly upon the head of the knight, the slider (46) moves downwardly into the body of the horse, against the action of the helical tension spring (49) until, eventually, the stop pin (51) reaches the upper end of the slot (47). This downward movement of the slider (46) essentially causes progressive unfolding of the "lazy tongs" device until substantially the attacking disposition shown in FIG. 64 of the drawings is reached. The dimensions of the lazy tongs device are such that at least the blade of the axe (44) will strike an opposing playing piece at the opposite corner of a rectangle of six playing squares towards which opposite corner the knight is facing and the aymmetric configuration of the "lazy tongs" device is such that it will arch over the tops of any other playing pieces that may intervene between the knight (43) and the opposing playing piece that is attacked. As soon as the downward finger pressure on the head of the knight is withdrawn, the spring (49) automatically restores the position shown in FIGS. 54 and 68 in which position the "lazy tongs" device is folded up to regain the appearance of the axe (44) and the shield (45) being protectively held by the armoured and helmeted equestrian knight (43). The knight (43) has a base (53) which is so shaped that, when it fits into the recess of any one of the playing squares (2), it will face towards the opposite corner of a rectangle of six of those squares (2). It is, of course, up to the player to direct the knight (43) towards the required playing square (2) but the configuration of the base (53) prevents the knight from occupying a position in which it is facing, for example, in a direction parallel to one of the edges of the baord (1) or a direction at 45 degrees to any edge of the board (1). The base (53) is of octagonal shape, but is not a regular octagon, having eight sides that are equidistant from the centre of the octagon. Assuming that the equestrain knight (43) faces due north, that is to say, that the blade of the axe (44) is due north from the body of the knight 43 when in the unfolded attacking position shown in FIG. 64, imaginary lines that extend perpendicularly from the eight octagon sides to its geometric centre, as follows, considered in a clockwise direction as seen in plan view. An imaginary due north datum line will be at 0 degrees due north and the first perpendicular will be at 26.57 degrees, the second will be at 79.7 degrees, the third will be at 116.57 degrees, the fourth will be at 169.7 degrees, the firth will be at 206.56 degrees, the sixth will be at 260 degrees, the seventh will be at 296.56 degrees, and the eighth will be at 349.7 degrees.

As can be seen in FIG. 69, in particular, of the drawings, the various playing pieces may carry decorative motifs in desired positions such as, purely for example, at the fronts of the queen playpieces (27), king playpieces (23) and panw playpieces (15) but it is emphasised that the decorative motifs in the drawing are purely by way of example and that alternative appearances and decorations may, if desired, be adopted or the playpieces in question may be left entirely plain. Purely for example, decorative motifs may be applied at the backs and at the fronts of the various playing pieces and each knight (43) may have such motifs applied to both sides of its shield (45) for display when that shield is folded into the non-attacking or rest position, as seen in FIG. 54 of the drawings. It has already been remarked that a basic procedure in the game of chess is to advance pawns towards the opposite sides of the board where they may be promoted to queens or knights. In fact, it is within the rules of the game to promote them to any pieces other than pawns, but, in practice, only promotions to queens or knights are ever made. In view of the animated nature of the various pieces, it would be desirable in any chess set produced in accordance with the invention to provide both the black and white sides with at least one extra knight and, preferably, at least two extra queens, these pieces only being employed when pawn promotions are made and the initial queen and knights are still in play (i.e. not "taken"). Thus, a pawn which is promoted to, for example, an additional queen, merely is removed from the board and one of the extra queens is substituted. In view of the animation of the playing pieces, this procedure is considered to be superior to procedures such as substituting already taken and inverted rooks/castles for promoted pawns. Advantageously, but not essentially, the playing board (1) of a chess set in accordance with the invention has the recesses in its individual playing squares (2) of such a size that they, proportionally, are 25 mm in both breath and width and are approximately 3 to 4 mm in depth, by way of example only.

FIGS. 71,72 and 73 show the configuration of a play board construction that would permit the application of real or synthetic leather liners (54) into the laying squares (2) of the modified playboard (55), as shown in a partial plan view in FIG. 73, and partial cross sectional view in FIG. 72 whereby the liners (54) are glued in place onto plastic vacuum formed tray (56) which is moulded to a 64 squares pattern whereby a raised moulded edge separates each square (2) from its adjacent squares (2) and any adjacent edges of the board, the bottoms of playing squares (2) and any adjacent edges of the play board (55), the bottoms of the recesses of the playing squares (2) being glued to the bottom supporting rigid panel (57) provide a permanent bond between the plastic tray (56) and the board whilst the empty spaces between the raised portions of the tray (56) and the supporting panel (57) are filled by a latticed board (58) or strips of board so as to provide resistance and support to the raised portions of the plastic tray to any crushing forces.

FIGS. 74 and 75 show the alternative configuration of a play board of which upper playing squares (2) elements are all of injection moulded plastics materials and of such configuration as to be of easy assembly whereby the play board (59) is made up of a laminated core of two rigid materials panels (60) and (61) which are suitably perforated to provide, in the upper panel (60), holes to engage the lower appendaces (62A) of the playing squares (62) and of the playing area edge mouldings (63), and in the lower panel (61) clearance holes to provide clearance to such lower appendaces (62A), the pattern of holes in this lower panel (61) being hidden by the purely "cosmetic" cover (64) which may be a green felt material or any other lining material. The borders between each playing square and the playing squares along the edges of the playing area and the playing area edge mouldings are clearly defined by mouldings of contrasting colours which are wedged between and are held by the edges of the playing squares mouldings (62) and the playing area edge mouldings (63). Such a play board configuration would be relatively simple to produce whilst still retaining a certain degree of quality and good appearance.

FIG. 76 illustrates another form of play board which by its mode of construction incorporates a storage box configuration with a compartmented tray (65) fitted beneath the play board, so as to protect the playpieces whilst in storage in conjunction with resilient sheet (66), the box four side panels (67), lid panel (68) and play board assembly (70) forming protective enclosure to its content of play pieces. The play board play squares (62) are as described for the alternative play board (59) but in this instance the plain plastic moulding is covered by a real or simulated leather lining (54). This mode of construction of the play board differs, by way of example, from play board (55) by way of the mechanical restraining in place rather than by glueing of the vacuum formed plastic tray (56) whereby the plastic tray (56) is also suitably perforated as would be panel (61) whilst the play board play area edges mouldings, shown here of natural wood substance, are held in place by way of, for example, heat sensitive glue applied onto upper panel (60) through appropriate holes (72). The box four side panels mouldings (67) are so moulded as to incorporate engaging channels for the fitting and holding of decorative natural wood strips (71).

I claim:

1. A chess set comprising an eight by eight pattern of sixty four playing squares on a chess game playing board and two sets of visually distinct playing pieces each comprising eight pawns, two knights, two bishops, two rooks/castles, one queen and one king, said playing board having each of the sixty four playing squares characterised by a centrally situated and substantially square recess of equal size, shape and alignment in all said playing squares, and in cooperative relation with each of the playing pieces, said playing pieces having means such that each playing piece is animated to display and act a diverse bellicose activity appropriate to the character of each type of playpiece by activation by a player-person to cause each distinct play piece when activated to physically attack an opposing playpiece that is to be "taken" during a move of the game; each playpiece further characterised in that the bases of each playing piece and the recesses of each of the playing board playing squares have an interdependent cooperating relationship such that, at least, the bases of the kings, queens, rooks/castles, bishops and knights playpieces cannot establish the cooperating relationship with any playing squares of the playing board when facing a direction that is unallowable in accordance with the traditional rules of the game of chess, whilst all the bases of the playiing pieces in their inter-dependent relationships with the playing squares are characterised by the centrally situated recesses whereby the base of each of the playing pieces rest on the playing squares' recessed configurations which recessed configurations allow the directional positioning of the playing pieces so that they will establish only correct directional attitudes that the playpieces' representational and activatable animated means may be aimed correctly and only in the directions to which directions the playpieces are permitted to move in accordance with the rules of the game of chess, each play piece animated means being able to physically reach and strike any of the opponent playpieces anywhere about the playing board in accordance with the permitted moves as allowed by the traditional rules of the game of chess.

2. A chess set according to claim 1, characterised in that the profiled recesses of the playing board playing squares are of substantially square configuration in shape as viewed from above.

3. A chess set according to claim 1, characterised in that said animated means of the pawn play pieces and the king play pieces is such that activation of the play pieces animation causes a hand held representational weapon appropriate in character with the playpiece role to be swung at in a reprentationally agressive stance and to physically strike a playing piece occupying any one adjacent square, that is allowably attackable in accordance with the traditional rules of the game of chess.

4. A chess set according to claim 1, characterised in that said animated means of the bishop play pieces, rook/castle playpieces and queen playpieces is such that it is activated to launch and propel a projectile, the projectile being capable of physically striking opposing playing pieces that are allowably attackable on any square of the play board in accordance with the rules of the traditional game of chess.

5. A chess set according to claim 1, characterised in that said animated means of the knight play pieces is such that it may be activated to cause a hand held and hand wielded representational weapon of a representational horse mounted knight warrior to be extended forward, upward and downward in an arcuate path from the warrior's shield by way of laterally and symmetrically placed sets of asymmetrical sets of links and levers, generally describing a "lazy tongs" principle effect, which system of links and levers is embodied in the simulated weapon and shield configuration of the armament of the representational horse mounted knight warrior, the weapon and shield system upon being extended does by-pass any play pieces located in any of the adjacent play squares and when fully extended the tip end of the simulated weapon does reach and physically strike any playpiece at which the agressor play piece is directed at the agressee playpiece on any play square which is the diagonally opposite play square of a three by two rectangular pattern of six play squares in accordance with the traditional rules of the game of chess.

6. A chess set according to any of the preceding claims, characterised in that said animated means of each playing piece is operable, to cause the activation of that playpiece representational weapon actuation mechanism by manipulation of the upper playpiece body component characterised by a queen, and bishop playpiece head with head gear and a rook/caastle upper tower extension, such manipulative action being characterised by a rotational hand activated movement of the play piece upper body component about the play piece vertical body axis.

7. A chess set according to any of the claims from claim 1 to claim 5 inclusive, characterised in that said animated means of each playing piece is operable, to cause the activation of a play piece representational weapon actuation mechanism by manipulation of an upper play piece body component characterised by a pawn and king play piece head with head gear, such manipulative action being characterised by a downward movement of the playpiece head upper body component about the play piece vertical body axis.

8. A chess set according to the preceeding claims 3 or 5 whereby upon completion of the manipulative activation of the play pieces' agressional stance, the de-activation of the agressive stance of the play pieces with the return of the play pieces attitude to the "at rest", non agressive stance is effected by a "return spring" characterised by it being able to release such stored compressional or tensional forces generated during the input of energy expended in the activation of the playpiece agressive stance sequence, this energy as released is able to power the play piece activating mechanism that the play piece activating mechanism is driven to return the play piece stance to the "at rest" attitude once the activating manipulative force is withdrawn from the playpiece.

9. A chess set according to the preceeding claim 4 whereby the activation of the actuating mechanism that propels the projectile is characterised by the presence of a spring as part of the actuation mechanism which upon activation of the actuating mechanism said actuating spring suddenly releases its stored energy to suddenly and forcibly displace a lever system which transfers such outburst of energy from the spring to an abutting projectile to forcibly propel such projectile in a trajectory determined by the attitude of the play piece and its built in projectile firing barrel, the now spent spring is then restored to readiness to fire again by further rotation of the head of the play piece.

10. A chess set in accordance with claim 1, wherein the play board is characterised by a laminated formation comprising an upper layer of playing squares whereby each playing square surrounding an upper annular panel and the basal component of the recess are characterised by being derived from the same square panel of wood, the recess being generated by the die cutting/punching out of the concentric square panel of the recess from the matrix square panel, both components affixed to a supporting laminated substructure at the appropriate levels to thus generate a recess to each play square of the play board.

11. A chess set in accordance with claims 1 or 10 wherein the play squares of the play board being of natural wood, and having the concentric recess panel component die cut/punched out of its central area, incorporate moulded coloured liners characterised by moulded/die cast plastic or metal materials, in order to hide the unattractive lateral appearance of the sides of the recess cavity.

12. A chess set in accordance with claim 1 wherein the play board play squares panels incorporating concentric recesses are characterised by each play panel being moulded to incorporate the recess feature in one-piece recessed play panel pieces, characterised by being made of rigid or semi rigid mouldable substances.

13. A chess set in accordance with claim 1, wherein the play board play squares panels are defined by a surround of exposed raised ridges extending upward from a play pieces' underlying vacuum formed plastic tray interposed between the play board playing squares panels and supporting laminated sub-structure of the play board.

* * * * *